US009370926B2

(12) United States Patent
Sano

(10) Patent No.: US 9,370,926 B2
(45) Date of Patent: Jun. 21, 2016

(54) INK-JET RECORDING APPARATUS AND MEDIA TRAY

(71) Applicant: BROTHER KOGYO KABUSHIKI KAISHA, Nagoya-shi, Aichi-ken (JP)

(72) Inventor: Iwane Sano, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/493,422

(22) Filed: Sep. 23, 2014

(65) Prior Publication Data

US 2015/0091998 A1 Apr. 2, 2015

(30) Foreign Application Priority Data

Sep. 30, 2013 (JP) ..... 2013-204966

(51) Int. Cl.

| | |
|---|---|
| ***B41J 2/01*** | (2006.01) |
| ***B65H 1/04*** | (2006.01) |
| ***B65H 3/06*** | (2006.01) |
| ***B41J 3/407*** | (2006.01) |
| ***B41J 13/02*** | (2006.01) |
| ***B41J 13/10*** | (2006.01) |
| ***B65H 5/06*** | (2006.01) |
| ***B65H 5/36*** | (2006.01) |

(52) U.S. Cl.

CPC ..... *B41J 2/01* (2013.01); *B41J 3/4071* (2013.01); *B41J 13/025* (2013.01); *B41J 13/10* (2013.01); *B65H 1/04* (2013.01); *B65H 3/0684* (2013.01); *B65H 5/062* (2013.01); *B65H 5/36* (2013.01); *B65H 2404/1442* (2013.01); *B65H 2405/324* (2013.01); *B65H 2407/21* (2013.01)

(58) Field of Classification Search

None

See application file for complete search history.

(56) References Cited

U.S. PATENT DOCUMENTS

| | | | | |
|---|---|---|---|---|
| 7,628,558 | B2 * | 12/2009 | Takeshita | B41J 3/4071 400/578 |
| 2004/0017462 | A1 | 1/2004 | Takahashi et al. | |
| 2012/0091650 | A1 * | 4/2012 | Ota | B41J 3/4073 271/3.18 |
| 2012/0188320 | A1 * | 7/2012 | Iijima | B41J 3/4073 347/104 |
| 2013/0135389 | A1 * | 5/2013 | Ito | B41J 11/02 347/37 |

FOREIGN PATENT DOCUMENTS

| | | | |
|---|---|---|---|
| JP | 11-138923 | A | 5/1999 |
| JP | 2004-042384 | A | 2/2004 |

* cited by examiner

*Primary Examiner* — An Do
*Assistant Examiner* — Renee I Wilson
(74) *Attorney, Agent, or Firm* — Merchant & Gould P.C.

(57) ABSTRACT

An ink-jet recording apparatus includes: a media tray; a roller pair capable of selectively conveying the media tray and a sheet; a recording device disposed downstream of the roller pair in a conveying direction and configured to eject ink droplets; lower contact portions disposed downstream of the roller pair in the conveying direction; and an upper contact portion configured to cooperate with the lower contact portions to corrugate the sheet. The media tray has a downstream edge portion in a tray inserting direction in which the media tray is inserted. The downstream edge portion has at least one inclined portion inclining obliquely upward toward an upstream side in the tray inserting direction. The at least one inclined portion contacts the upper contact portion to move the upper contact portion upward.

17 Claims, 12 Drawing Sheets

INK-JET RECORDING APPARATUS AND MEDIA TRAY

CROSS REFERENCE TO RELATED APPLICATION

The present application claims priority from Japanese Patent Application No. 2013-204966, which was filed on Sep. 30, 2013, the disclosure of which is herein incorporated by reference in its entirety.

BACKGROUND

1. Technical Field

The present invention relates to an ink-jet recording apparatus including a recording head configured to record an image on a sheet by ejecting ink droplets from nozzles of the recording head and relates to a media tray to be inserted into the ink-jet recording apparatus and capable of supporting the recording medium.

2. Description of the Related Art

An ink-jet recording apparatus may suffer from a malfunction called cockling. The cockling refers to deformation of a sheet in areas with ink droplets having permeated, and this deformation may bend the sheet. In the event of the cockling on the sheet, the deformed sheet may contact the recording head or cause a sheet jam, for example.

One example of an ink-jet recording apparatus for solving such problems is a recording apparatus including ribs and elastic members. In this recording apparatus, the ribs extend in a sheet conveying direction and are provided on a platen for supporting the sheet. The elastic members are arranged upstream of an ink ejection area of the platen and on a side of the sheet nearer to its recording surface so as to be located between the ribs in a widthwise direction which intersects the conveying direction. The elastic members are elastically deformed so as to push the sheet to a position below upper edges of the ribs. This construction corrugate the sheets in the widthwise direction, making it difficult for the sheet to be bent.

There is also known an ink-jet recording apparatus capable of recording an image on a recording medium such as a CD and a DVD in addition to the sheet. When the image recording is performed on the recording medium such as the CD and the DVD, the recording medium is placed on a media tray. The media tray is inserted from an insertion opening formed in the ink-jet recording apparatus and conveyed in the ink-jet recording apparatus.

SUMMARY

However, in a construction in which the sheet is corrugated as in the above-described recording apparatus, there is a possibility in which the media tray inserted from the insertion opening comes into contact with the elastic members, which inhibits the media tray from moving to a position for image recording.

This invention has been developed to provide a technique allowing a media tray capable of supporting a recording medium to be inserted without being interrupted by a component for corrugating a sheet.

The present invention provides an ink-jet recording apparatus including: a media tray configured to support a recording medium; a roller pair including a first roller and a second roller opposite the first roller, a state of the roller pair being switched between a first state in which the first roller and the second roller nip a sheet and a second state in which the first roller and the second roller are spaced apart from each other by a greater distance than in the first state and capable of nipping the media tray; a recording device including a plurality of nozzles and disposed downstream of the roller pair in a conveying direction in which the sheet is conveyed, the recording device being configured to eject ink droplets from the plurality of nozzles onto one of the sheet and the recording medium supported on the media tray; a plurality of lower contact portions disposed downstream of a sheet nipping position of the roller pair in the conveying direction, the plurality of lower contact portions being arranged spaced apart from each other in a widthwise direction intersecting the conveying direction, the plurality of lower contact portions being configured to contact a lower side of the sheet; and at least one upper contact portion disposed between the sheet nipping position of the roller pair and the plurality of nozzles in the conveying direction, the at least one upper contact portion being disposed between adjacent two of the plurality of lower contact portions in the widthwise direction, the at least one upper contact portion being configured to contact an upper side of the sheet, the at least one upper contact portion being configured to cooperate with the plurality of lower contact portions to corrugate the sheet. The media tray includes a downstream edge portion in a tray inserting direction in which the media tray is inserted. The downstream edge portion is provided with at least one inclined portion inclining obliquely upward toward an upstream side in the tray inserting direction. The at least one inclined portion is configured to contact the at least one upper contact portion to move the at least one upper contact portion upward.

The present invention also provides a media tray to be inserted into an ink-jet recording apparatus. The media tray includes: a media tray body having a plate shape; and a support portion which is provided on an upper face of the media tray body and supports a recording medium on which an image is to be recorded by the ink-jet recording apparatus. The ink-jet recording apparatus includes: a roller pair configured to nip and convey one of a sheet and the media tray; a recording device including a plurality of nozzles and disposed downstream of a sheet nipping position of the roller pair in a conveying direction in which the sheet is conveyed, the recording device being configured to eject ink droplets from the plurality of nozzles onto one of the sheet and the recording medium supported on the media tray; a plurality of lower contact portions disposed downstream of the sheet nipping position of the roller pair in the conveying direction, the plurality of lower contact portions being arranged spaced apart from each other in a widthwise direction intersecting the conveying direction, the plurality of lower contact portions being configured to contact a lower side of the sheet; and at least one upper contact portion disposed between the sheet nipping position of the roller pair and the plurality of nozzles in the conveying direction, the at least one upper contact portion being disposed between adjacent two of the plurality of lower contact portions in the widthwise direction, the at least one upper contact portion being configured to contact an upper side of the sheet, the at least one upper contact portion being configured to cooperate with the plurality of lower contact portions to corrugate the sheet. The media tray includes a downstream edge portion in a tray inserting direction in which the media tray is inserted, the downstream edge portion being at least a portion of the upper face of the media tray body. The downstream edge portion is provided with at least one inclined portion inclining obliquely upward in the tray inserting direction. The at least one inclined portion is configured to contact the at least one upper contact portion to move the at least one upper contact portion upward.

The present invention also provides an ink-jet recording apparatus including: a media tray configured to support a recording medium; a roller pair configured to nip and convey one of the media tray and a sheet; a recording device including a plurality of nozzles and configured to eject ink droplets from the plurality of nozzles onto one of the sheet and the recording medium supported on the media tray; and a corrugating mechanism including at least one first contact portion provided in a conveyance path through which the media tray and the sheet are conveyed. The corrugating mechanism is configured to corrugate the sheet. The media tray includes a guide portion provided on a distal end portion of the media tray in a tray inserting direction in which the media tray is inserted into the conveyance path. The guide portion is configured to be brought into contact with the at least one first contact portion to move the at least one first contact portion in a direction away from the conveyance path.

According to the configuration as described above, while the media tray is being inserted into the ink-jet recording apparatus for image recording on the recording medium, the at least one inclined portion of the media tray is brought into contact with the at least one upper contact portion. This contact causes the at least one upper contact portion to be slid relative to the at least one inclined portion. As a result, the at least one upper contact portion is guided upward along the at least one inclined portion and moved to a position located on an upper side of the media tray. The configuration described above can lower a possibility that the media tray is caught by the at least one upper contact portion, which inhibits the insertion of the media tray.

Effects

In the present invention, a media tray capable of supporting a recording medium can be inserted into an ink-jet recording apparatus without being inhibited by at least one upper contact portion for corrugating a sheet.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 3A and 3B are elevational views in vertical cross section schematically illustrating components around guide portions of a lever, wherein FIG. 3A illustrates a state in which the lever is located at a first position, and FIG. 3B illustrates a state in which a state in which the lever is located at a second position;

FIGS. 5A-5C are cross-sectional views schematically illustrating a conveying roller pair and the guide portions of the lever, wherein FIG. 5A illustrates a state in which pinch rollers are in contact with the conveying roller, FIG. 5B illustrates a state in which the pinch rollers are spaced apart from the conveying roller, and FIG. 5C illustrates a state in which the pinch rollers are spaced apart from the conveying roller;

FIGS. 9A-9C are plan views illustrating components around contact members and a downstream edge portion of the media tray conveyed through the straight portion, wherein FIG. 9A illustrates a state in which the downstream edge portion has not reached the contact members, FIG. 9B illustrates a state in which first inclined faces formed in fourth regions are in contact with contact portions, and FIG. 9C illustrates a state in which first inclined faces formed in third regions are in contact with the contact portions;

FIGS. 10A and 10B are plan views illustrating components around the contact members and the downstream edge portion of the media tray conveyed through the straight portion, wherein FIG. 10A illustrates a state in which the third regions are in contact with the pinch rollers, and FIG. 10B illustrates a state in which the media tray is nipped by the conveying roller pair;

FIGS. 11A-11F are views schematically illustrating components around the contact members and the downstream edge portion of the media tray conveyed through the straight portion in a tenth modification, wherein FIG. 11A is a plan view illustrating a state in which third inclined faces are in contact with protrusions, FIG. 11B is a cross-sectional view illustrating the state in which the third inclined faces are in contact with the protrusions, FIG. 11C is a plan view illustrating a state in which the first inclined faces are in contact with the contact portions, FIG. 11D is a cross-sectional view illustrating a state in which the first inclined faces are in contact with the contact portions, FIG. 11E is a plan view illustrating a state in which the contact members override the media tray, and FIG. 11F is a cross-sectional view illustrating the state in which the contact members override the media tray; and FIGS. 12A-12F are views illustrating components around the contact members and the downstream edge portion of the media tray conveyed through the straight portion, wherein FIG. 12A is a schematic cross-sectional view taken along line A-A in FIG. 9B, FIG. 12B is a schematic cross-sectional view taken along line B-B in FIG. 9B, FIG. 12C is a schematic cross-sectional view taken along line C-C in FIG. 9C, FIG. 12D is a schematic cross-sectional view taken along line D-D in FIG. 9C, FIG. 12E is a schematic cross-sectional view taken along line E-E in FIG. 10A, and FIG. 12F is a schematic cross-sectional view taken along line F-F in FIG. 10A.

DETAILED DESCRIPTION OF THE EMBODIMENT

Hereinafter, there will be described one embodiment of the present invention by reference to the drawings. It is to be understood that the following embodiment is described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is viewed from the front side.

Overall Construction of MFP 10

Figure 1:
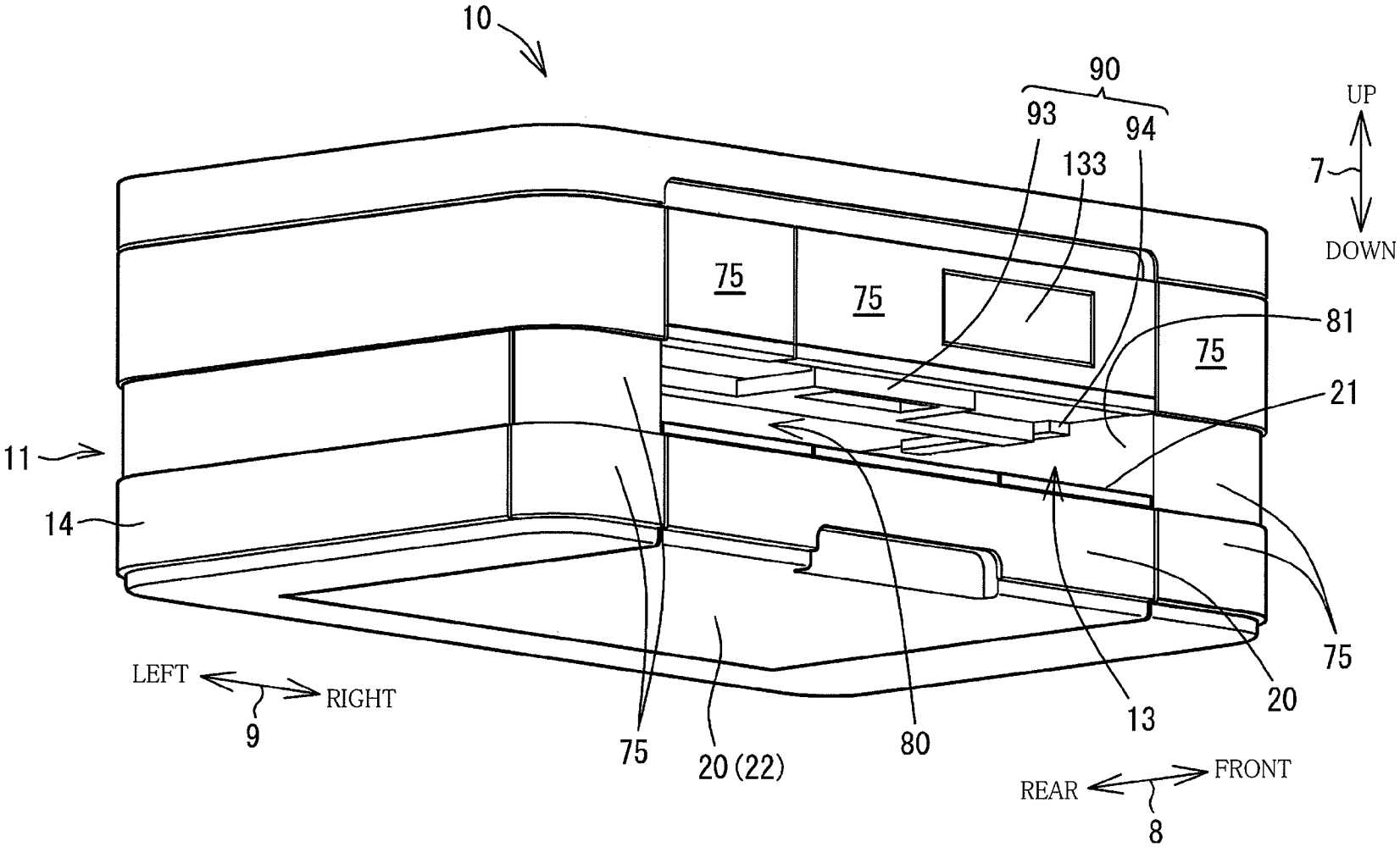
FIG. 1 is a perspective view illustrating a multi-function peripheral (MFP) as one example of an ink-jet recording apparatus according to one embodiment of the present invention.

As illustrated in FIG. 1, the MFP 10 as one example of an ink-jet recording apparatus is of a slim type having a generally rectangular parallelepiped shape. A printing section 11 is provided in a lower portion of the MFP 10. The MFP 10 has various functions such as a facsimile function and a printing function. One example of the printing function of the MFP 10 is an ink-jet recording function for ejecting ink to record an image on one side of a recording sheet 12 (see FIG. 2). It is noted that the MFP 10 may have a function for recording images on both sides of the recording sheet 12. The MFP 10 also has a function for recording an image on a face of a storage medium, not shown, as one example of a recording medium such as a CD-ROM and a DVD-ROM supported on a media tray 110 (see FIGS. 2, 7, and 8) which will be described below. This function will be explained later.

Supply Tray 20

Figure 2:
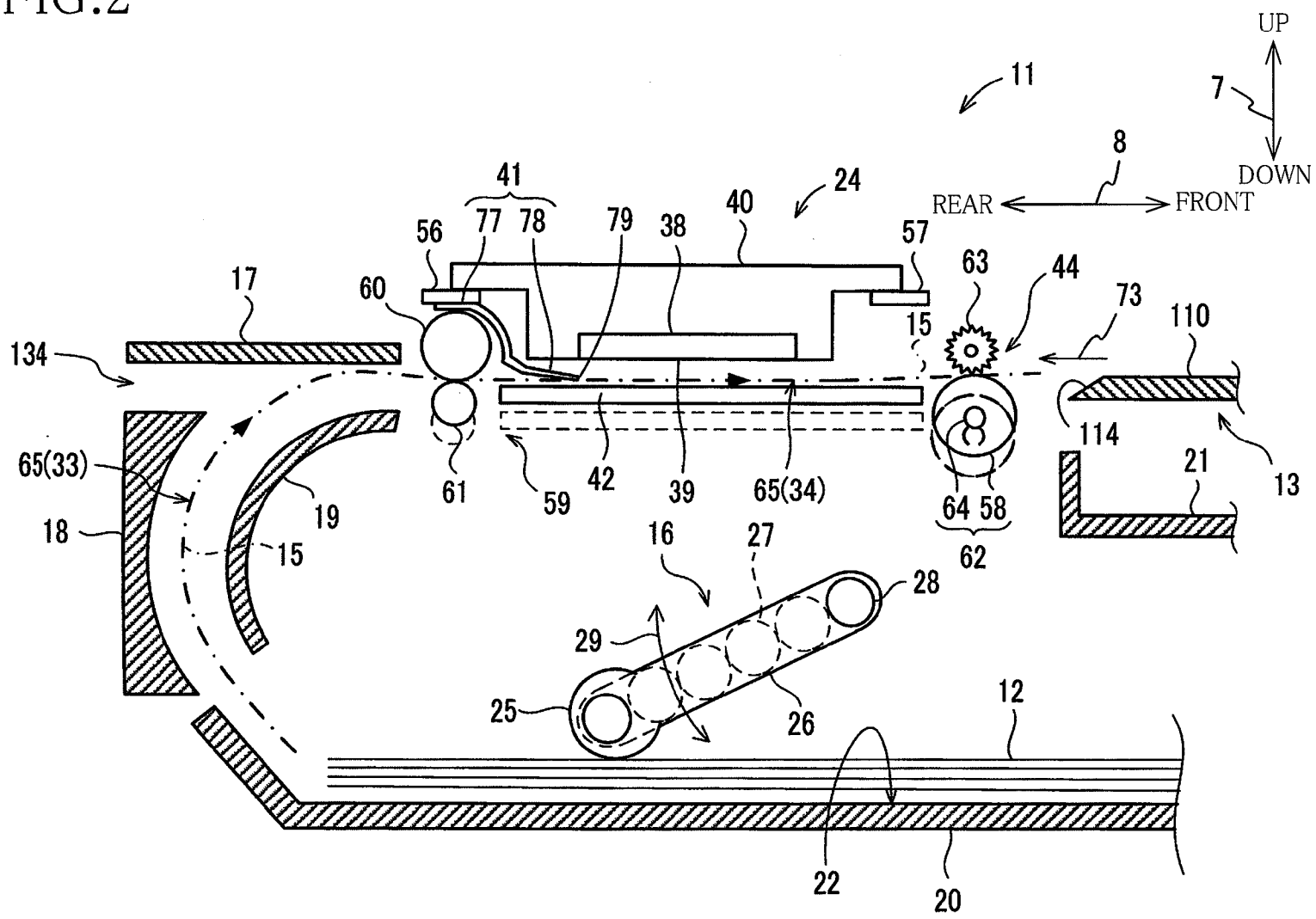
FIG. 2 is an elevational view in vertical cross section schematically illustrating an internal structure of a printing section.

As illustrated in FIG. 1, the printing section 11 includes a housing 14 having a front face 75 formed with the opening 13. A front portion of the housing 14 has a recessed portion 80 which is recessed rearward through the opening 13. A supply tray 20 is insertable and removable into and from the recessed portion 80 in the front and rear direction 8. The supply tray 20 is shaped like a box opening upward. As illustrated in FIG. 2, a plurality of recording sheets 12 can be supported on a bottom plate 22 of the supply tray 20. An output tray 21 is supported above and in front of the supply tray 20. The output tray 21 is moved together with the supply tray 20 in the front and rear direction 8. The recording sheet 12 on which the image is recorded by a recording unit 24, as one example of a recording device, which will be described below is discharged onto an upper surface of the output tray 21.

Supply Unit 16

As illustrated in FIG. 2, a supply unit 16 is provided directly above the bottom plate 22 of the supply tray 20 fitted in the recessed portion 80. The supply unit 16 includes a supply roller 25, a supply arm 26, and a drive-power transmitting mechanism 27. The supply roller 25 is supported at its shaft by a distal end portion of the supply arm 26. The supply arm 26 can pivot about a support shaft 28 provided on a proximal end portion of the supply arm 26 in a direction indicated by arrow 29. The pivotal movement of the supply arm 26 moves the supply roller 25 to and away from the bottom plate 22 of the supply tray 20 or an uppermost one of the recording sheets 12 stacked on the supply tray 20.

The supply roller 25 is rotated by driving power produced by a conveyor motor, not shown, which is transmitted by the drive-power transmitting mechanism 27 constituted by a plurality of gears. When the supply roller 25 is rotated in a state in which the supply roller 25 is held in contact with an uppermost one of the recording sheets 12 stacked on the bottom plate 22 of the supply tray 20, the uppermost sheet 12 is supplied to a conveyance path 65 which will be described below. It is noted that the supply roller 25 may be rotated by driving power supplied from a motor which is provided separately from the conveyor motor.

Conveyance Path 65

In the housing 14, as illustrated in FIG. 2, the conveyance path 65 extends from a rear end portion of the supply tray 20. The conveyance path 65 includes a curved portion 33 and a straight portion 34. The curved portion 33 is curved upward from the rear end portion of the supply tray 20. The straight portion 34 extends in the front and rear direction 8.

The curved portion 33 is defined by an outer guide member 18 and an inner guide member 19 which are opposed to each other at a predetermined distance. The straight portion 34 is defined, in an area in which the recording unit 24 is disposed, by the recording unit 24 and a platen 42 which are opposed to each other at a predetermined distance. In an area at a rear of the recording unit 24, the straight portion 34 is defined by an upper guide member 17 and the outer guide member 18.

The recording sheet 12 supported by the supply tray 20 is supplied to the curved portion 33 by the supply roller 25 and conveyed through the curved portion 33 and the straight portion 34 in a conveying direction 15 indicated by the dot-dash arrow in FIG. 2. The media tray 110 is inserted into the straight portion 34 from the opening 13 and conveyed along the straight portion 34 in the front and rear direction 8.

Recording Unit 24

As illustrated in FIG. 2, the recording unit 24 is provided over the straight portion 34. The platen 42 is provided under the recording unit 24 so as to be opposed to the recording unit 24.

Figure 6:
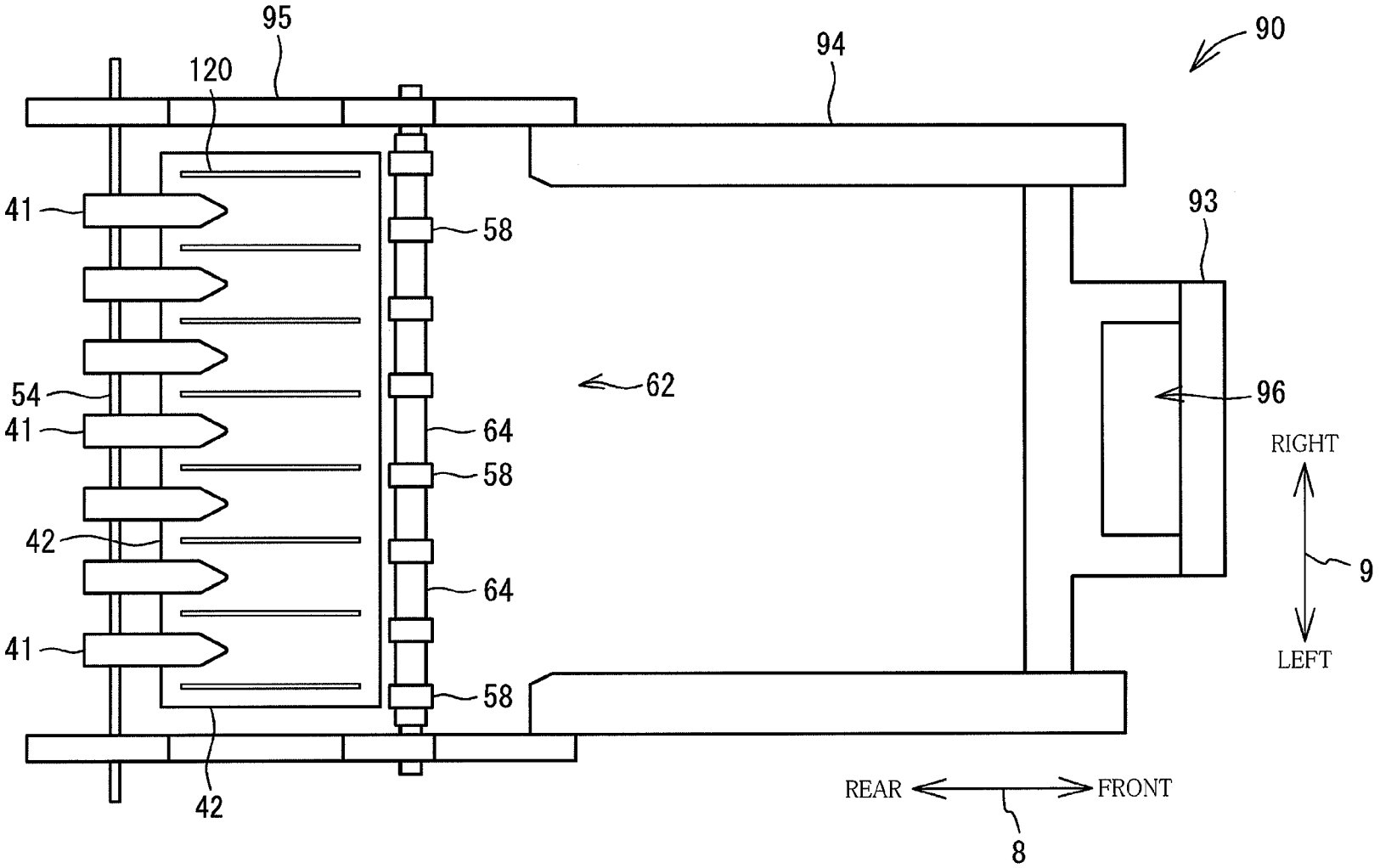
FIG. 6 is a plan view schematically illustrating the lever.

The platen 42 is shaped like a planar plate which is longer in the front and rear direction 8 and in the right and left direction 9 than in the up and down direction 7. As illustrated in FIG. 6, the platen 42 includes a plurality of ribs 120 as one example of a plurality of lower contact portions provided on an upper surface of the platen 42. The ribs 120 each extending in the front and rear direction 8 are spaced apart from each other in the right and left direction 9, as one example of a widthwise direction, perpendicular to the conveying direction 15. The ribs 120 contact a lower side of the recording sheet 12 conveyed through the straight portion 34. That is, the ribs 120 support the recording sheet 12. It is noted that the shape of the platen 42 is not limited to the planar shape. The direction in which the ribs 120 are spaced apart from each other is not limited to the right and left direction 9 perpendicular to the conveying direction 15 and may be any direction as long as the direction intersects the conveying direction 15.

As illustrated in FIG. 2, the recording unit 24 includes a carriage 40 and a recording head 38. The carriage 40 is supported by two guide rails 56, 57 arranged so as to be spaced apart from each other in the front and rear direction 8. The carriage 40 can be reciprocated in the right and left direction 9 on these guide rails 56, 57. The recording head 38 is mounted on the carriage 40. Ink is supplied to the recording head 38 from an ink cartridge, not shown. A lower surface of the recording head 38 has nozzles 39 formed therein. While the carriage 40 is being moved in the right and left direction 9, the recording head 38 ejects ink droplets from the nozzles 39 toward the platen 42 to form an image on the recording sheet 12 conveyed in the conveying direction 15 and supported on the platen 42 or the storage medium supported on the media tray 110.

Conveying Roller Pair 59 and Output Roller Pair 44

As illustrated in FIG. 2, the conveyor roller pair 59 is disposed upstream of the recording unit 24 and the platen 42 and downstream of the supply tray 20 in the conveying direction 15 in the straight portion 34. An output roller pair 44 is disposed downstream of the recording unit 24 in the conveying direction 15 in the straight portion 34.

Figure 4:
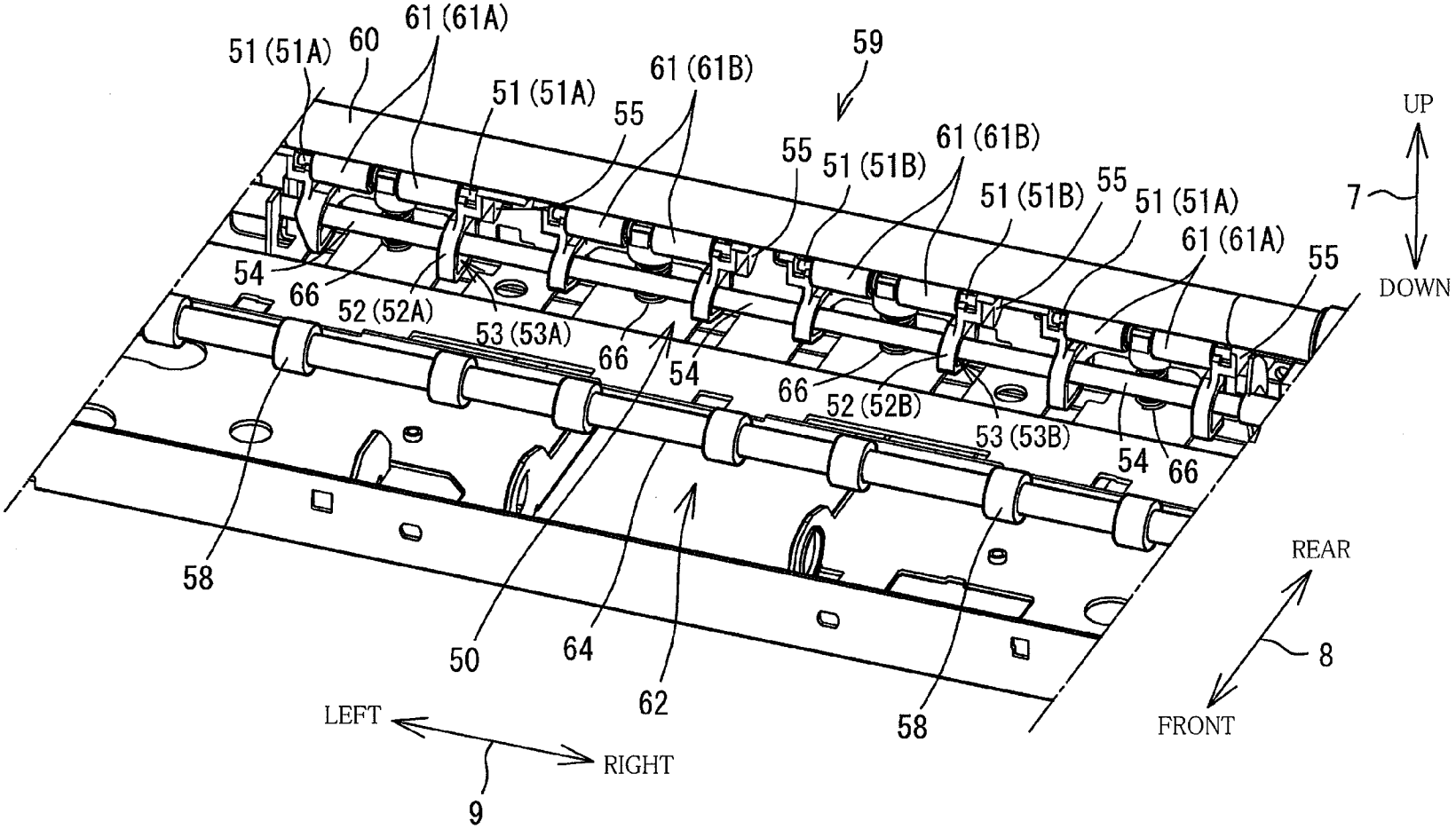
FIG. 4 is a perspective view illustrating components around a moving mechanism.

As illustrated in FIGS. 2 and 4, the conveyor roller pair 59 is constituted by (i) a conveyor roller 60 as one example of a first roller disposed partly in an upper portion of the straight portion 34 and (ii) pinch rollers 61 each as one example of a second roller disposed partly in a lower portion of the straight portion 34 so as to be opposed to the conveyor roller 60. The conveyor roller 60 is a circular cylindrical component extending in the right and left direction 9. The pinch rollers 61 are spaced apart from each other in the right and left direction 9. The pinch rollers 61 are rotatably supported respectively by supporters 55 of a moving mechanism 50 which will be described below. The supporters 55 are respectively urged by elastic members 66 toward the conveying roller 60. In the above-described construction, the pinch rollers 61 are urged by the respective elastic members 66 toward the conveyor roller 60 and pressed against the conveyor roller 60. While four pairs of the pinch rollers 61, i.e., the eight pinch rollers 61 are provided in the present embodiment, the number of the pinch rollers 61 is not limited to eight.

As illustrated in FIG. 2, the output roller pair 44 is constituted by (i) an output roller 62 disposed partly in a lower portion of the straight portion 34 and (ii) spurs 63 disposed partly in an upper portion of the straight portion 34 so as to be opposed to the output roller 62. As illustrated in FIG. 4, the output roller 62 includes a shaft 64 extending in the right and left direction 9 and roller portions 58 mounted on the shaft 64 so as to be spaced apart from each other in the right and left direction 9. The spurs 63 are also spaced apart from each other in the right and left direction 9 so as to be opposed to the respective roller portions 58. The output roller 62 is urged by elastic members toward the spurs 63.

Each of the conveyor roller pair 59 and the output roller pair 44 can nip the recording sheet 12 or the media tray 110 as will be described below. Each of the conveyor roller 60 and the output roller 62 is rotated forwardly by forward-rotation driving power produced by the conveyor motor, not shown, and rotated reversely by reverse-rotation driving power produced by the conveyor motor.

When the conveyor roller 60 is rotated forwardly in a state in which the recording sheet 12 or the media tray 110 is nipped by the conveyor roller pair 59, the recording sheet 12 or the media tray 110 is conveyed by the conveyor roller pair 59 through the straight portion 34 in the conveying direction 15, i.e., the front direction. When the conveyor roller 60 is rotated reversely in that state, the recording sheet 12 or the media tray 110 is conveyed by the conveyor roller pair 59 through the straight portion 34 in a direction opposite the conveying direction 15, i.e., the rear direction.

When the output roller 62 is rotated forwardly in a state in which the recording sheet 12 or the media tray 110 is nipped by the output roller pair 44, the recording sheet 12 or the media tray 110 is conveyed by the output roller pair 44 through the straight portion 34 in the conveying direction 15, i.e., the front direction and discharged onto the output tray 21. When the output roller 62 is rotated reversely in that state, the recording sheet 12 or the media tray 110 is conveyed by the output roller pair 44 through the straight portion 34 in the direction opposite the conveying direction 15, i.e., the rear direction.

Switch of States of Conveying Roller Pair 59, Output Roller Pair 44, and Platen 42

As illustrated in FIGS. 4 and 5A-5C, the printing section 11 includes the moving mechanism 50. The moving mechanism 50 includes: the supporters 55; protrusions 52 each having a hole 53 and projecting in the down direction from a corresponding one of opposite end portions of the supporters 55; a shaft 54 extending in the right and left direction 9 and inserted through the holes 53; and a lever 90 which will be described below. Right and left end portions of the shaft 54 are respectively inserted in openings 91 formed in the lever 90 (see FIG. 3).

The pinch rollers 61 include pinch rollers 61A and pinch rollers 61B. The pinch rollers 61A are provided right and left sides of the pinch rollers 61B arranged at a central area in the right and left direction 9. The protrusions 52 includes: protrusions 52A provided on a shaft 51A for the pinch rollers 61A; and protrusions 52B provided on a shaft 51B for the pinch rollers 61B.

Here, the pinch rollers 61A are respectively arranged on right and left sides, i.e., opposite sides, in the right and left direction 9, of a support region 111 (see FIG. 7) provided on the media tray 110 in a state in which the media tray 110 is inserted in the MFP 10. The pinch rollers 61B are respectively arranged at positions corresponding to the support region 111 in the right and left direction 9 in the state in which the media tray 110 is inserted in the MFP 10.

Upper ends of inner circumferential surfaces of holes 53A formed in the respective protrusions 52A are the same in height position as upper ends of inner circumferential surfaces of holes 53B formed in the protrusions 52B. Lower ends of the inner circumferential surfaces of the respective holes 53A are lower in height position than lower ends of the inner circumferential surfaces of the respective holes 53B. That is, each of the holes 53A is larger in size than each of the holes 53B.

Right and left end portions of the shaft 64 of the output roller 62 are respectively inserted in openings 92 formed in the lever 90 (see FIG. 3).

As will be described below, movement of the shaft 54 in the up and down direction 7 switches the state of the conveyor roller pair 59 selectively to one of (i) a first state (see FIG. 5A) in which the conveyor roller 60 and the pinch rollers 61 are in contact with each other and can nip the recording sheet 12 therebetween and (ii) a second state (see FIG. 5C) in which the pinch rollers 61 and the conveyor roller 60 are spaced apart from each other and can nip the media tray 110 therebetween. Also, movement of the shaft 64 of the output roller 62 in the up and down direction 7 switches the state of the output roller pair 44 selectively to one of (i) a first state (indicated by the solid lines in FIG. 2) in which the spurs 63 and the output roller 62 are in contact with each other and can nip the recording sheet 12 therebetween and (ii) a second state (indicated by the broken lines in FIG. 2) in which the output roller 62 and the spurs 63 are spaced apart from each other and can nip the media tray 110. It is noted that the shaft 54 and the shaft 64 are moved upward and downward by movement of the lever 90 in the front and rear direction 8 as will be described below.

Figure 3A:
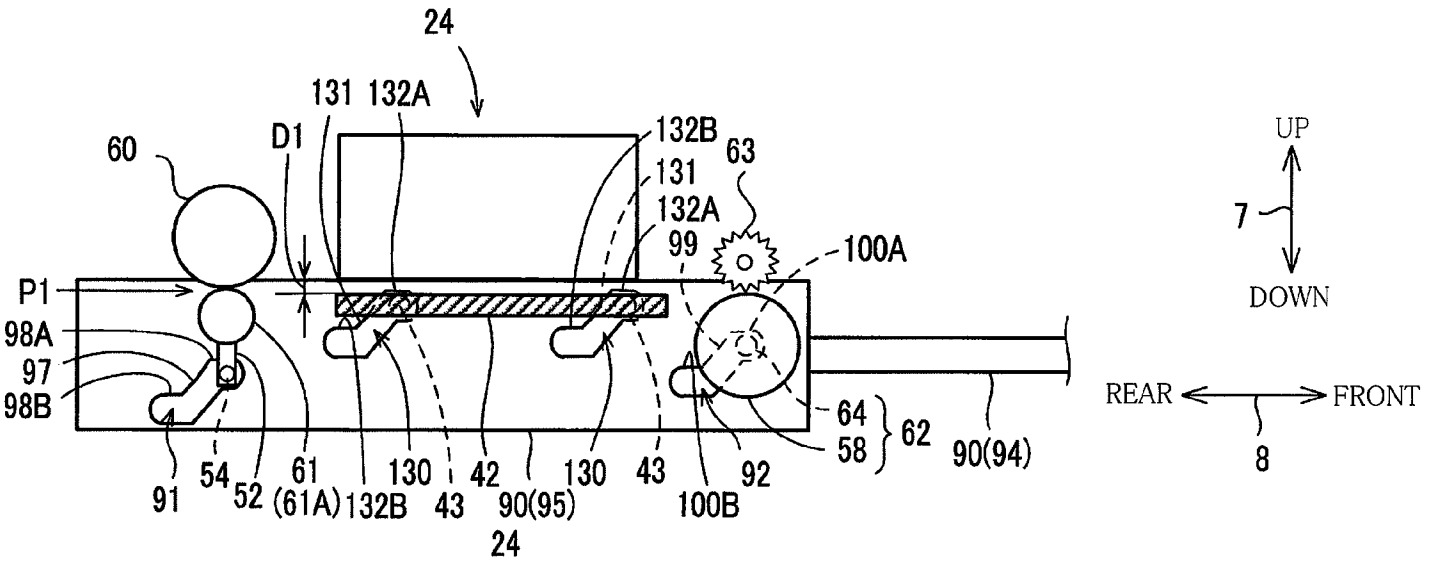
Figure 3B:
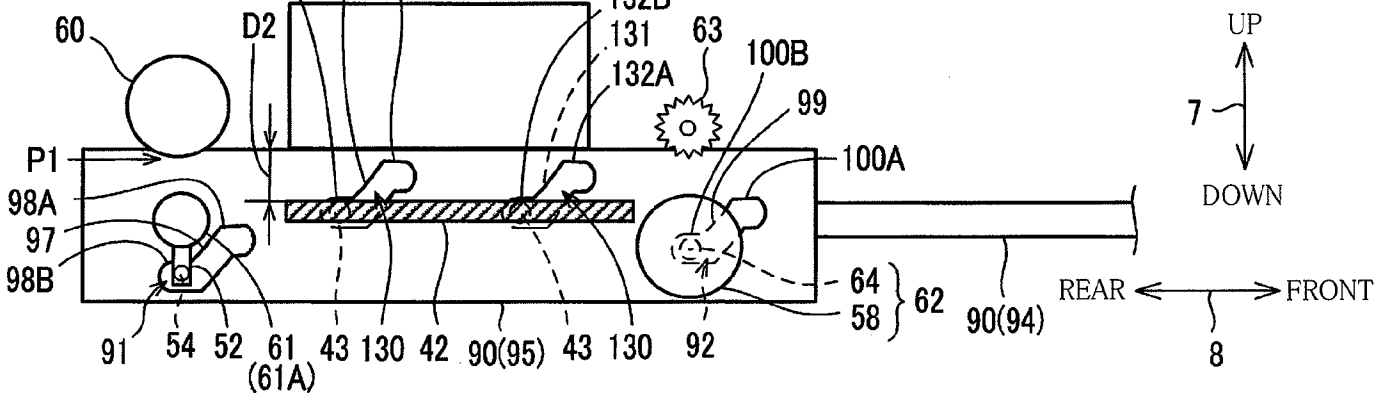

As illustrated in FIGS. 3A and 3B, projections 43 projecting outward are respectively provided on right and left faces of the platen 42. The projections 43 are respectively fitted in openings 130 formed in the lever 90. As will be described below, the state of the platen 42 is switched, by upward and downward movement of the projections 43, selectively to one of (i) a first state (see FIG. 3A) in which the platen 42 is spaced apart from the recording unit 24 at a distance D1 and (ii) a second state (see FIG. 3B) in which the platen 42 is spaced apart from the recording unit 24 at a distance D2 which is greater than the distance D1.

When the recording sheet 12 is conveyed through the straight portion 34, the platen 42 is in the first state to support the recording sheet 12. When the media tray 110 is conveyed through the straight portion 34, on the other hand, the platen 42 is in the second state, that is, the platen 42 is located below the media tray 110 to be conveyed. This construction avoids a contact of the media tray 110 with the platen 42.

In view of the above, each of the conveyor roller pair 59, the output roller pair 44, and the platen 42 is in the first state when image recording is performed on the recording sheet 12, and is in the second state when image recording is performed on the storage medium supported on the media tray 110. A user can switch the state of each component between the first state and the second state by moving the lever 90 which will be described below.

Lever 90

As illustrated in FIGS. 3A and 3B, the printing section 11 is equipped with the lever 90 provided movably in the front and rear direction 8. The lever 90 is movable between a first position illustrated in FIG. 3A and a second position illustrated in FIG. 3B which is in front of the first position.

As illustrated in FIG. 6, the lever 90 includes: a handle 93 to be held by the user; a pair of guide portions 95 extending in the front and rear direction 8; and a pair of connecting portions 94 for connecting the handle 93 and the guide portions 95. The connecting portions 94 extend rearward respectively from right and left end portions of the handle 93 such that rear end portions of the connecting portions 94 are connected to front end portions of the respective guide portions 95 extending rearward.

As illustrated in FIG. 1, the handle 93 is disposed near the opening 13 in the recessed portion 80 and near an upper end of the opening 13. As illustrated in FIG. 6, the handle 93 extends in the right and left direction 9 and has an opening 96 at its central portion in the right and left direction 9. The user can insert his or her fingers into the opening 96 to hold the handle 93.

Each of the connecting portions 94 is shaped like a planar plate elongated in the front and rear direction 8. One of the pair of connecting portions 94 extends in the front and rear direction 8 near a right edge and an upper edge of the recessed portion 80. The other of the pair of connecting portions 94 extends in the front and rear direction 8 near a left edge and the upper edge of the recessed portion 80. The connecting portions 94 are supported by inside faces 81 of the housing 14 of the printing section 11 (see FIG. 1) so as to be movable in the front and rear direction 8.

As illustrated in FIGS. 3A, 3B, and 6, the guide portions 95 extend from the output roller pair 44 to a rear side of the conveyor roller pair 59 in the front and rear direction 8. The guide portions 95 are arranged respectively on a right side of a right edge of the conveyance path 65 and on a left side of a left edge of the conveyance path 65. The guide portions 95 are supported by a frame 82 (see FIGS. 9 and 10) of the printing section 11.

As illustrated in FIGS. 3A and 3B, each of the guide portions 95 has the openings 91, 92 and the two openings 130. The opening 91 is defined by an inclined face 97 whose front portion is located above its rear portion, a horizontal face 98A connected to a front end of the inclined face 97 and extending in the front and rear direction 8, and a horizontal face 98B connected to a rear end of the inclined face 97 and extending in the front and rear direction 8.

The opening 92 is defined by an inclined face 99 whose front portion is located above its rear portion, a horizontal face 100A connected to a front end of the inclined face 99 and extending in the front and rear direction 8, and a horizontal face 100B connected to a rear end of the inclined face 99 and extending in the front and rear direction 8.

Each of the openings 130 is defined by an inclined face 131 whose front portion is located above its rear portion, a horizontal face 132A connected to a front end of the inclined face 131 and extending in the front and rear direction 8, and a horizontal face 132B connected to a rear end of the inclined face 131 and extending in the front and rear direction 8.

Figures 5A, 5B, 5C:
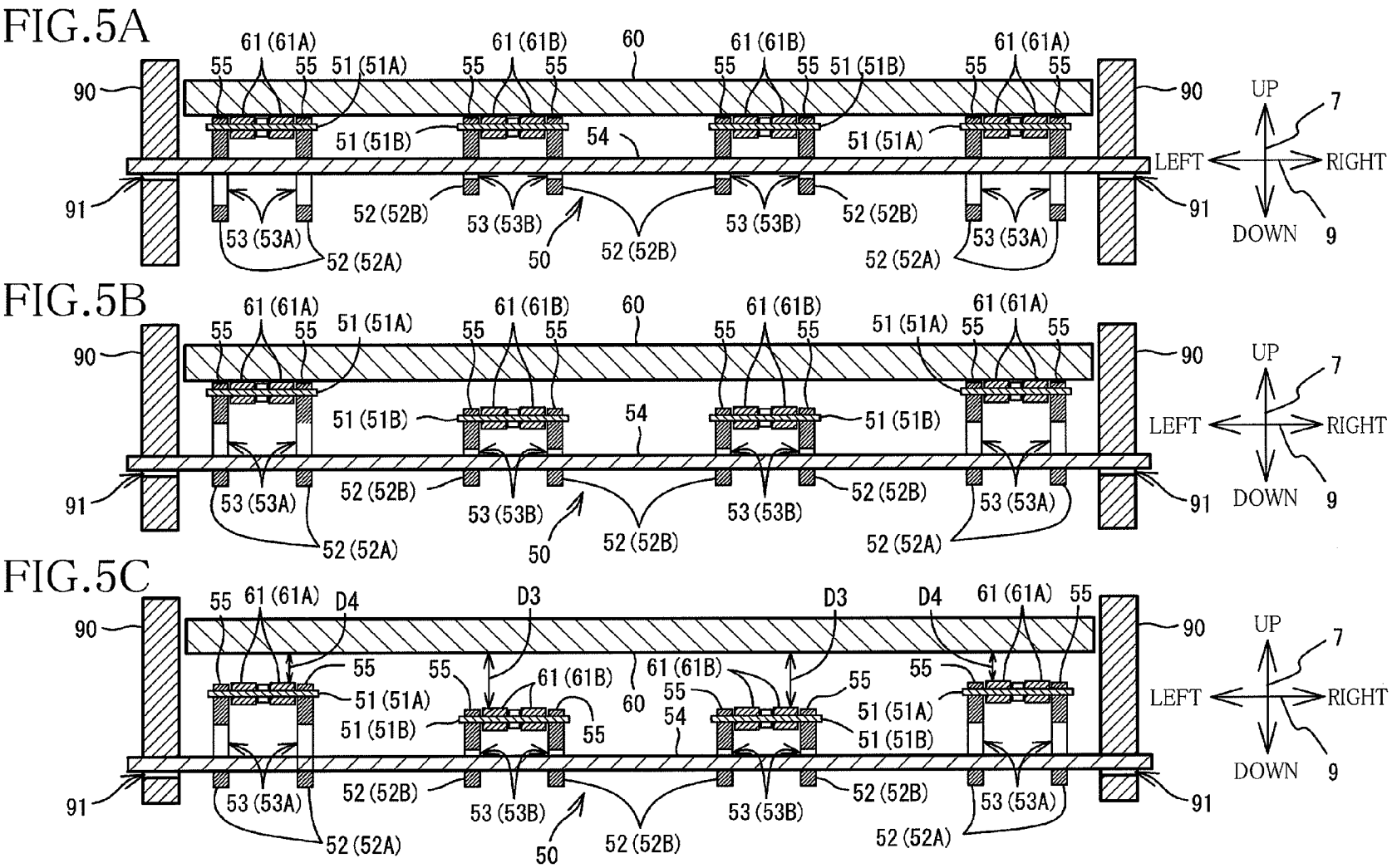

There will be next explained the switch of the state of the conveyor roller pair 59 with the movement of the lever 90. As illustrated in FIGS. 3A and 5A, when the lever 90 is located at the first position, the shaft 54 is located under the horizontal faces 98A in the respective openings 91. In this state, the pinch rollers 61 are held in pressing contact with the conveyor roller 60 by urging forces of the elastic members 66 (see FIG. 4). That is, the conveyor roller pair 59 is in the first state.

When the user holds the handle 93 and pulls the lever 90 in the front direction, the lever 90 is moved frontward from the first position, so that the shaft 54 is brought into contact with the inclined faces 97. When the lever 90 is further moved frontward, the shaft 54 is slid relative to the inclined faces 97. As a result, the shaft 54 is moved downward while guided by the inclined faces 97.

The shaft 54 is brought into contact with lower ends of inner circumferential faces of the holes 53B formed in the respective protrusions 52B and pushes the lower ends. This push lowers the supporters 55 formed integrally with the respective protrusions 52B and the pinch rollers 61B supported by the respective supporters 55. As a result, the pinch rollers 61B are moved away from the conveying roller 60. At this moment, the supporters 55 formed integrally with the respective protrusions 52A and the pinch rollers 61A supported by the respective supporters 55 are not moved.

When the lever 90 is further moved in the front direction in a state in which the pinch rollers 61B are spaced from the conveying roller 60, the shaft 54 is further moved in the down direction. As illustrated in FIG. 5B, the shaft 54 is brought into contact with lower ends of inner circumferential faces of the holes 53A formed in the respective protrusions 52A and pushes the lower ends. This push lowers the supporters 55 formed integrally with the respective protrusions 52A and the pinch rollers 61A supported by the respective supporters 55. As a result, as illustrated in FIG. 5C, the pinch rollers 61A are moved away from the conveying roller 60. That is, the second state of the conveying roller pair 59 is established.

When the lever 90 is thereafter moved further in the front direction, as illustrated in FIG. 3B, the shaft 54 is pressed against the horizontal faces 98B by the urging forces of the respective elastic members 66. At this time, the lever 90 has reached the second position. That is, when the lever 90 is located at the second position, the conveying roller pair 59 is in the second state.

In FIG. 5C, a distance D3 (as one example of a second distance) between the pinch rollers 61B and the conveyor roller 60 is greater than a distance D4 (as one example of a first distance) between the pinch rollers 61A and the conveyor roller 60. This is because the pinch rollers 61B have started to move downward before the pinch rollers 61A. That is, the moving mechanism 50 switches the conveying roller pair 59 from the first state to the second state by moving the pinch rollers 61A of the pinch rollers 61 by the distance D4 in the down direction in which the pinch rollers 61A is moved away from the conveying roller 60 and by moving the rest rollers of the pinch rollers 61, i.e., the pinch rollers 61B by the distance D3 in the down direction.

Here, the distance D3 is greater than the thickness of the media tray 110 which is the length of the media tray 110 in the up and down direction 7 in the state in which the media tray 100 is inserted in the MFP 10. The distance D4 is less than the thickness of the media tray 110. Accordingly, the media tray 110 inserted in the MFP 10 is nipped between the conveyor roller 60 and the pinch rollers 61A but not nipped between the conveyor roller 60 and the pinch rollers 61B.

There will be next explained the switch of the state of the output roller pair 44 with the movement of the lever 90. As illustrated in FIG. 3A, when the lever 90 is located at the first position, the shaft 64 of the output roller 62 is located under the horizontal faces 100A in the openings 92. In this state, the output roller 62 is held in contact with the spurs 63 by urging forces of elastic members, not shown. That is, the output roller pair 44 is in the first state.

When the user holds the handle 93 and pulls the lever 90 in the front direction, the lever 90 is moved from the first position in the front direction, so that the shaft 64 is brought into contact with the inclined faces 99. When the lever 90 is moved further in the front direction, the shaft 64 is slid relative to the inclined faces 99. As a result, the shaft 64 is moved downward. That is, the output roller 62 is moved downward while guided by the inclined faces 99 and spaced apart from the spurs 63. That is, the second state of the output roller pair 44 is established.

When the lever 90 is thereafter moved further in the front direction, as illustrated in FIG. 3B, the shaft 64 is pressed against the horizontal faces 100B by the urging forces of the elastic members. In this state, the lever 90 is located at the second position. That is, when the lever 90 is located at the second position, the output roller pair 44 is in the second state.

There will be next explained the switch of the state of the platen 42 with the movement of the lever 90. As illustrated in FIG. 3A, when the lever 90 is located at the first position, each of the projections 43 provided on the platen 42 is located under the horizontal face 132A defining a corresponding one of the openings 130. In this state, the platen 42 is in the first state.

When the user holds the handle 93 and pulls the lever 90 in the front direction, the lever 90 is moved from the first position in the front direction, so that the projections 43 are brought into contact with the respective inclined faces 131. When the lever 90 is moved further in the front direction, the projections 43 are slid relative to the respective inclined faces 131. As a result, the projections 43 are moved downward. That is, the platen 42 is moved downward, and the second state thereof is established.

When the lever 90 is thereafter moved further in the front direction, as illustrated in FIG. 3B, the projections 43 are pressed against the respective horizontal faces 132B by urging forces of elastic members, not shown. In this state, the lever 90 is located at the second position. That is, when the lever 90 is located at the second position, the platen 42 is in the second state.

When the lever 90 is moved from the second position to the first position, the above-described operations are performed in reverse. That is, the shaft 54 is moved off the horizontal faces 98B and slid relative to the inclined faces 97, so that the pinch rollers 61 are moved upward and brought into contact with the conveyor roller 60. Also, the shaft 64 is moved off the horizontal faces 100B and slid on the inclined faces 99, so that the output roller 62 is moved upward and brought into contact with the spurs 63. Also, the projections 43 are moved off the respective horizontal faces 132B and slid on the inclined faces 131, so that the platen 42 is moved upward.

In view of the above, the lever 90 is movable between a first position at which each of the conveying roller pair 59, the output roller pair 44, and the platen 42 is in the first state and a second position at which each of the conveying roller pair 59, the output roller pair 44, and the platen 42 is in the second state.

Contact Members 41

As illustrated in FIG. 2, contact members 41 are disposed upstream of the nozzles 39 in the straight portion 34. As illustrated in FIG. 6, each of the contact members 41 is disposed between corresponding adjacent two of the ribs 120 provided on the platen 42 in the right and left direction 9. While the seven contact members 41 are provided in the present embodiment, any number of the contact members 41 may be provided.

As illustrated in FIG. 2, each of the contact members 41 has: a basal end portion 77 mounted on the guide rail 56; and a contact portion 78 (as one example of an upper contact portion) disposed between the nozzles 39 and the conveying roller pair 59 in the conveying direction 15. The contact portions 78 incline from the upstream side to the downstream side in the conveying direction 15, that is, the contact portions 78 incline from a side of the contact portions 78 near the basal end portions 77 toward a side of the contact portions 78 near distal ends of the respective contact members 41. Distal ends 79 of the respective contact portions 78 are located below upper edges of the respective ribs 120. The distal ends 79 are located below a nipping position P1 at which the recording sheet 12 is nipped by the conveying roller pair 59 being in the first state (see FIG. 3A) and above the pinch rollers 61A being in the second state (see FIG. 3B).

The distal ends 79 contact an upper side of the recording sheet 12 conveyed through the straight portion 34. As a result, the recording sheet 12 is corrugated in the right and left direction 9 by the distal ends 79 contacting the recording sheet 12 from above and the ribs 120 contacting the recording sheet 12 from below. In other words, the recording sheet 12 is shaped into a series of regular or continuous folds that look like waves, by the distal ends 79 contacting the recording sheet 12 from above and the ribs 120 contacting the recording sheet 12 from below.

Media Tray 110

As described above, the MFP 10 has the function for recording an image on a face of the storage medium. In the case where an image is recorded on the storage medium, the storage medium is supported by the media tray 110. As illustrated in FIG. 2, the media tray 110 is inserted from the opening 13 into the straight portion 34 of the conveyance path 65 in the MFP 10 in the rear direction indicated by an arrow 73 as one example of a tray inserting direction. That is, the media tray 110 is inserted in the direction opposite the conveying direction 15 from a downstream side of the recording unit 24 in the conveying direction 15. The media tray 110 inserted into the straight portion 34 is conveyed in the front and rear direction 8 through the straight portion 34 while nipped by the conveying roller pair 59 and the output roller pair 44 being in the second state. As in the case of the recording sheet 12, the recording unit 24 ejects ink droplets onto the storage medium placed on the media tray 110 being conveyed just under the recording unit 24, so that an image is recorded on the storage medium.

Figure 7:
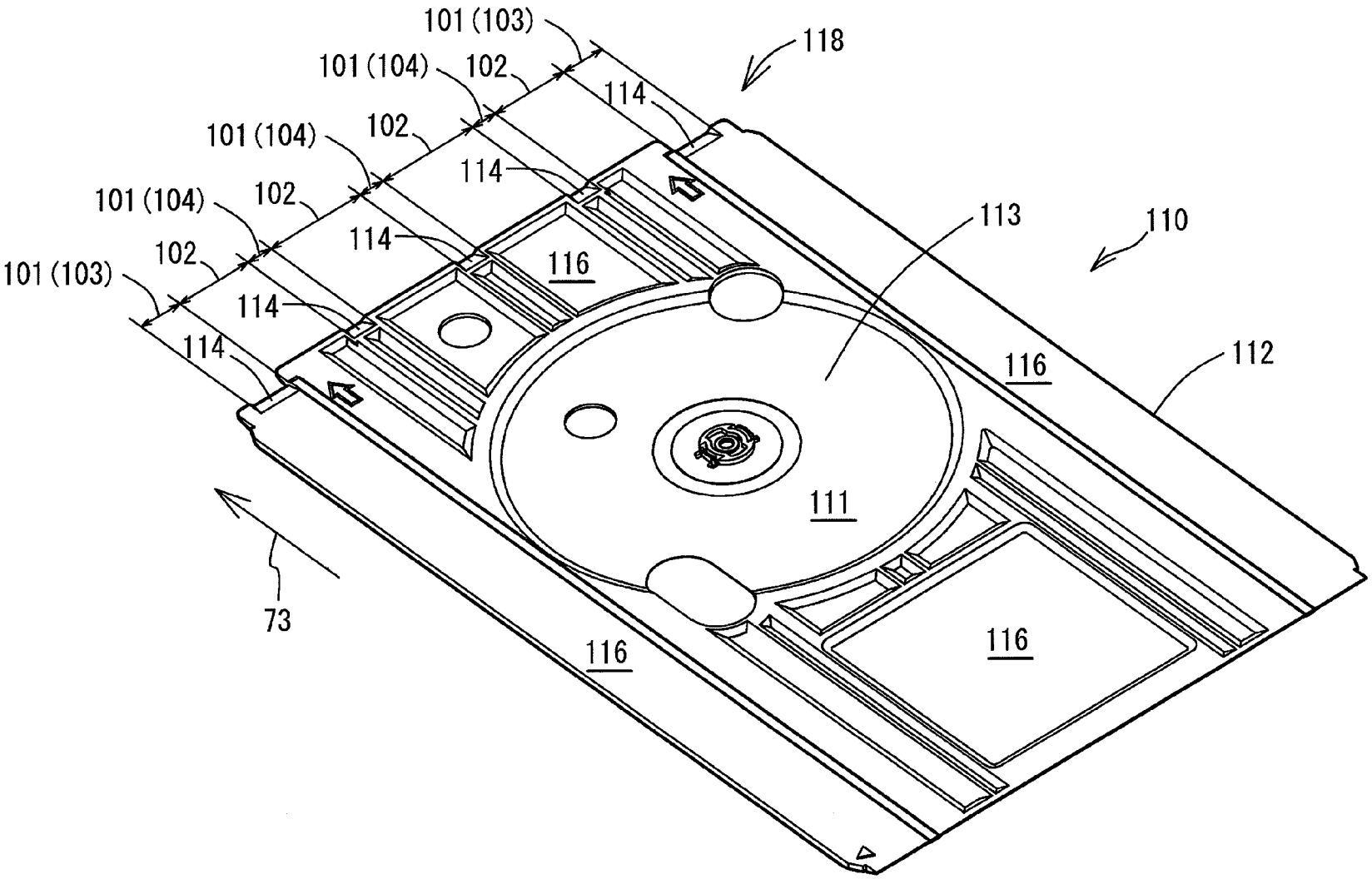
FIG. 7 is a perspective view of a media tray viewed from above.
Figure 8:
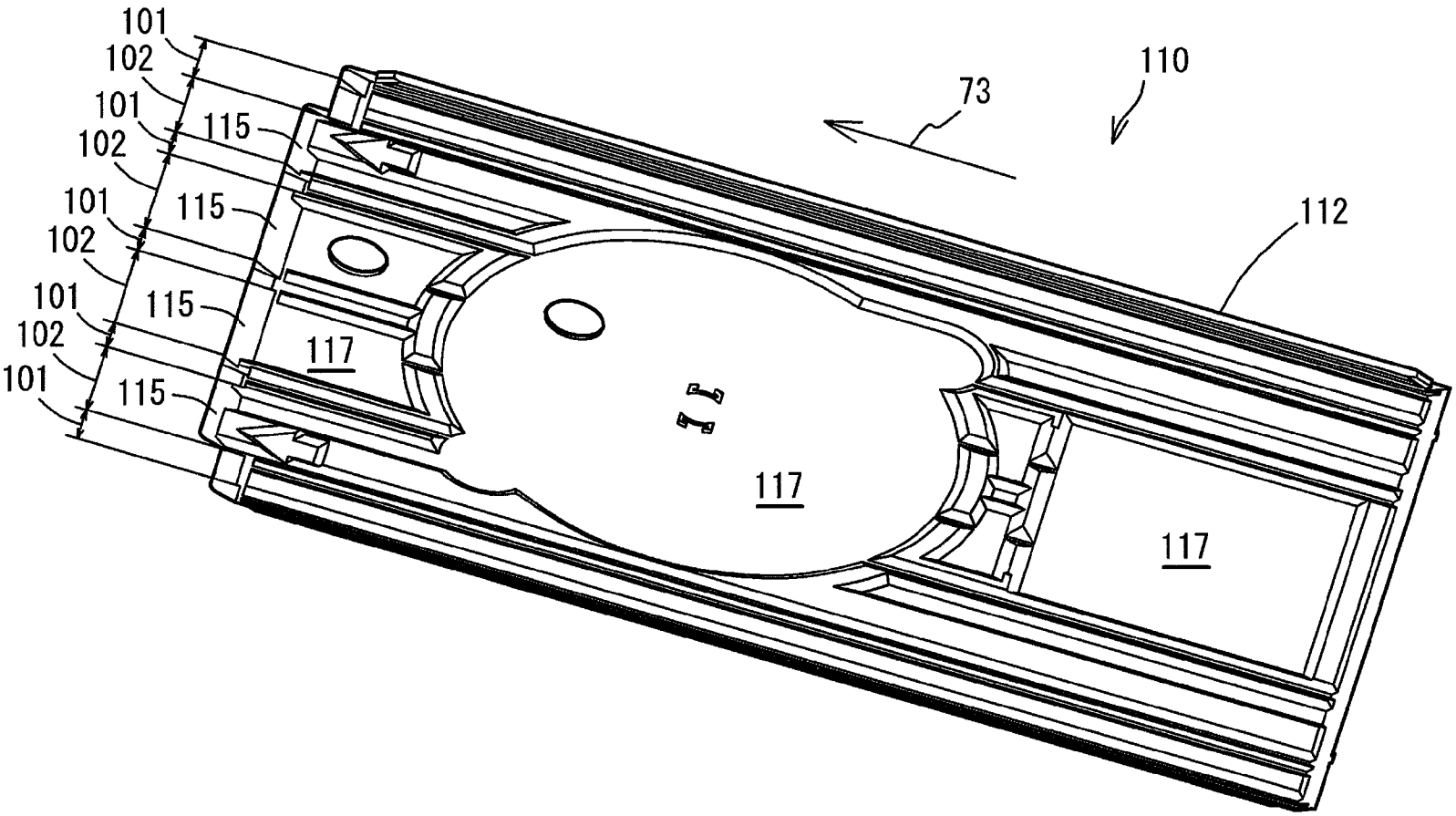
FIG. 8 is a perspective view of the media tray viewed from below.

As illustrated in FIGS. 7 and 8, the media tray 110 includes: a media tray body 112 which is a resin plate shaped like a thin plate; a support portion 113 provided on one of opposite faces of the media tray body 112 (specifically, the one face is an upper face 116 in the state in which the media tray 110 is inserted in the MFP 10); first inclined faces 114, each as one example of an inclined portion, provided on the one of the opposite faces; and second inclined faces 115 provided on the other of the opposite faces which is reverse to the one of the opposite faces (specifically, the other face is a lower face 117 in the state in which the media tray 110 is inserted in the MFP 10).

The support portion 113 is a recess having a round shape. The storage medium is supported on this recess. The size and shape of the recess are substantially the same as those of the storage medium to be placed. A region of a bottom face of this recess is the above-described support region 111.

As illustrated in FIG. 7, the first inclined faces 114 are provided on a downstream edge portion 118 of the upper face 116 in the direction indicated by the arrow 73. The first inclined faces 114 incline obliquely upward in a direction opposite the direction indicated by the arrow 73, from a downstream edge of the downstream edge portion 118 in the direction indicated by the arrow 73. The first inclined faces 114 are arranged corresponding to the contact portions 78 of the respective contact members 41. In other words, the first inclined faces 114 are arranged at positions corresponding to the contact portions 78 of the respective contact members 41 in the right and left direction 9.

The downstream edge portion 118 of the media tray body 112 in the direction indicated by the arrow 73 is constituted in the right and left direction 9 by portions (each as one example of a first portion) respectively corresponding to first regions 101 and portions (each as one example of a second portion) respectively corresponding to second regions 102. Each of the first regions 101 is a region in the right and left direction 9 on a portion of the downstream edge portion 118 on which a corresponding one of the first inclined faces 114 is formed. Each of the second regions 102 is a region in the right and left direction 9 on a portion of the downstream edge portion 118 on which no first inclined faces 114 are formed. Downstream edges of the portions corresponding to the respective second regions 102 in the direction indicated by the arrow 73 are located at higher position than downstream edges of the portions corresponding to the respective first regions 101 in the direction indicated by the arrow 73.

The first regions 101 are constituted by: third regions 103 each of which is a region in the right and left direction 9 on a portion (as one example of a third portion) of the downstream edge portion 118 which is to contact a corresponding one of the pinch rollers 61A that move by the distance D4; and fourth regions 104 each of which is a region in the right and left direction 9 on a portion of the downstream edge portion 118 which is not to contact any of the pinch rollers 61.

The downstream edge portion 118 of the media tray body 112 in the direction indicated by the arrow 73 is constructed such that opposite end portions of the downstream edge portion 118 in the right and left direction 9 is located below a central portion of the downstream edge portion 118 in the right and left direction 9. That is, the portions corresponding to the respective third regions 103 are located upstream of the portions corresponding to the respective second regions 102 in the direction indicated by the arrow 73.

In a region occupied in the right and left direction 9 by the right one of the pinch rollers 61A of the pinch rollers 61, a right portion of the region overlaps the third region 103 of the media tray 110 inserted in the MFP 10 in the right and left direction 9, and a left portion of the region overlaps the second region 102 of the media tray 110 inserted in the MFP 10 in the right and left direction 9. Also, in a region occupied in the right and left direction 9 by the left one of the pinch rollers 61A of the pinch rollers 61, a left portion of the region overlaps the third region 103 of the media tray 110 inserted in the MFP 10 in the right and left direction 9, and a right portion of the region overlaps the second region 102 of the media tray 110 inserted in the MFP 10 in the right and left direction 9. That is, each of the pinch rollers 61A is located over a region containing both of the third region 103 and the second region 102 in the right and left direction 9.

As illustrated in FIG. 8, the second inclined faces 115 are provided on the lower face 117 of the downstream edge portion 118 in the direction indicated by the arrow 73. The second inclined faces 115 incline obliquely downward in the direction opposite the direction indicated by the arrow 73 from the downstream edge of the downstream edge portion 118 in the direction indicated by the arrow 73. The second inclined faces 115 are arranged on the respective second regions 102 in the right and left direction 9.

Operations of Media Tray 110

There will be next explained a procedure in which the media tray 110 is inserted into the MFP 10, and an image is recorded on the storage medium placed on the media tray 110. When the lever 90 is moved from the first position to the second position by the user, each of the conveying roller pair 59, the output roller pair 44, and the platen 42 is switched from the first state to the second state. That is, each of the pinch rollers 61, the output roller 62, and the platen 42 is moved from the position indicated by the solid lines in FIG. 2 to the position indicated by the broken lines in FIG. 2. These movements allow the conveyor roller pair 59 and the output roller pair 44 to nip and convey the media tray 110 along the straight portion 34. Also, the platen 42 is moved downward. That is, the platen 42 is moved to a position at which the platen 42 does not contact the media tray 110 conveyed through the straight portion 34.

The user then inserts the media tray 110 placed on the storage medium from the opening 13 through the recessed portion 80 in the rear direction toward the straight portion 34 in the printing section 11, with the downstream edge portion 118 being as a leading edge. In this operation, while supported by tray guides, not shown, provided on the inside faces 81 of the recessed portion 80, the media tray 110 is inserted to a position at which at least the downstream edge portion 118 is nipped by the output roller pair 44. It is noted that the media tray 110 may be inserted to a position located at a rear of this position, for example, the media tray 110 may be inserted to a position at which the downstream edge portion 118 is nipped by the conveyor roller pair 59.

The user then selects an image recording function by operating an operation panel 133 (see FIG. 1) provided on an upper portion of a front face of the MFP 10. In response, the conveyor motor transmits reverse-rotation driving power to the conveyor roller 60 and the output roller 62, so that the media tray 110 is conveyed by the output roller pair 44 in the rear direction through the straight portion 34, and the downstream edge portion 118 passes through the position just under the recording unit 24 (see FIG. 9A).

As illustrated in FIGS. 9A-9C, 10A, and 10B, the contact members 41 include contact members 41A-41D. In the following description explained with reference to FIGS. 9A-9C, 10A, 10B, and 12A-12F, operations of the media tray 110, the contact members 41A, 41B, and the conveying roller pair 59 at positions corresponding to the contact members 41A, 41B in the right and left direction 9 will be explained. However, since the media tray 110, the contact members 41C, 41D, and the conveying roller pair 59 are operated at positions corresponding to the contact members 41C, 41D in the right and left direction 9 in the same manner as at the positions corresponding to the contact members 41A, 41B, an explanation for the operations at the positions corresponding to the contact members 41C, 41D are dispensed with.

Figure 9A:
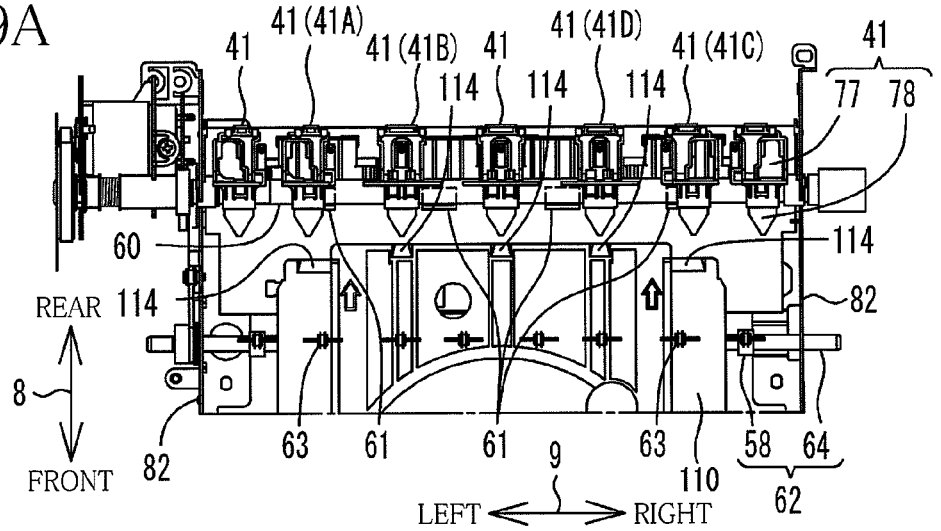
Figure 9B:
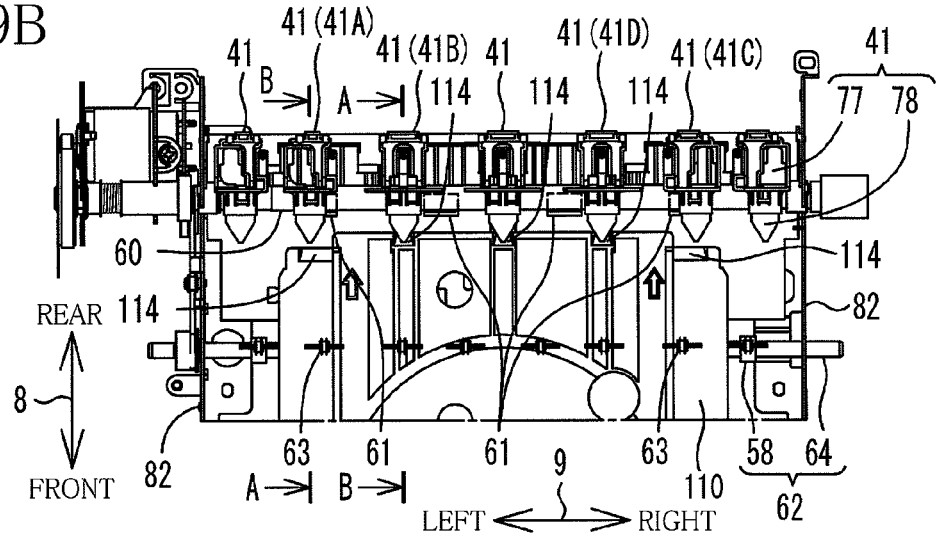
Figure 12A:
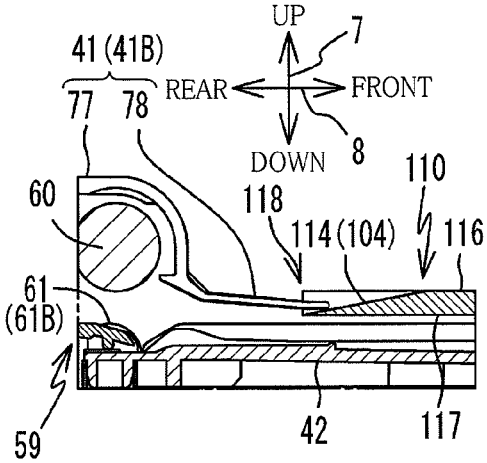

When the downstream edge portion 118 of the media tray 110 is moved further in the rear direction in the state illustrated in FIG. 9A, as illustrated in FIGS. 9B and 12A, the first inclined face 114 formed on the fourth region 104 of the downstream edge portion 118 is brought into contact with the contact portion 78 of the contact member 41B. As a result, the contact portion 78 is relatively moved along the first inclined face 114 of the media tray 110 conveyed rearward, so that the contact portion 78 is bent upward. That is, the contact portions 78 are lifted onto the media tray 110 by the first inclined faces 114 (see FIG. 12C). It is noted that in the state illustrated in FIG. 9B, the first inclined faces 114 formed on the third regions 103 of the downstream edge portion 118 have not reached the contact portion 78 of the contact member 41A (see FIG. 12B).

Figure 9C:
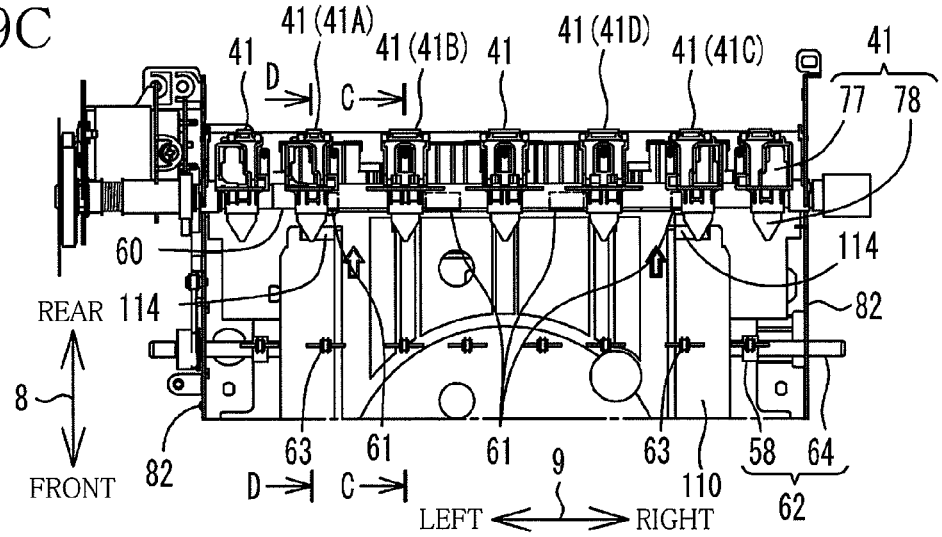
Figure 12B:
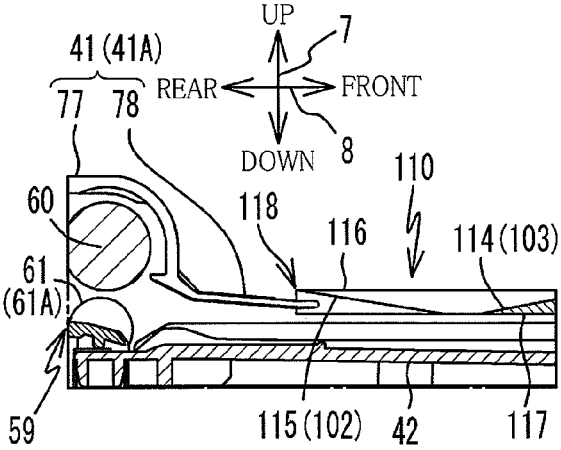
Figure 12C:
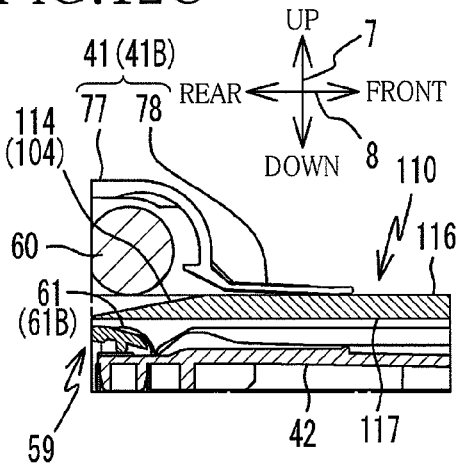
Figure 12D:
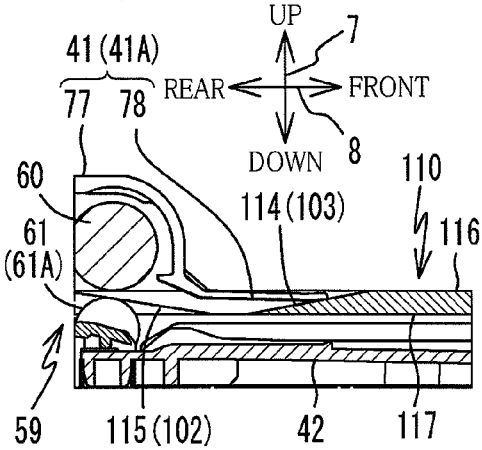

In the state illustrated in FIGS. 9B, 12A, and 12B, when the downstream edge portion 118 of the media tray 110 is moved further in the rear direction, as illustrated in FIGS. 9C and 12D, the second inclined faces 115 formed on the second regions 102 on the lower face 117 of the downstream edge portion 118 are brought into contact with upper end portions of the respective pinch rollers 61A. The second inclined faces 115 are brought into contact with right portions of the pinch rollers 61A. As a result, the pinch rollers 61A are pressed by the second inclined faces 115 and moved downward against the elastic members 66, so that the downstream edge portion 118 is nipped by the conveying roller pair 59 (see FIG. 12F).

Figure 12E:
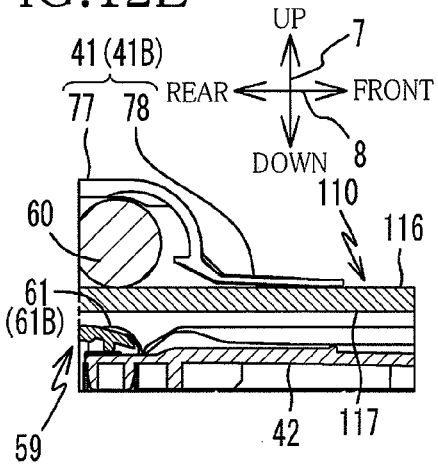

At this time, as illustrated in FIGS. 12C and 12E, the pinch rollers 61B do not contact the media tray 110 because the pinch rollers 61B have moved downward by the distance D3 that is greater than the thickness of the media tray 110.

In the state illustrated in FIGS. 9B, 12A, and 12B, when the downstream edge portion 118 of the media tray 110 is moved further in the rear direction, as illustrated in FIGS. 9C and 12D, the first inclined face 114 formed on the third region 103 of the downstream edge portion 118 is brought into contact with the contact portion 78 of the contact member 41A. As a result, as in the movement described above, the contact portion 78 is relatively moved along the first inclined face 114 and lifted onto the media tray 110 (see FIG. 12F).

Figure 10A:
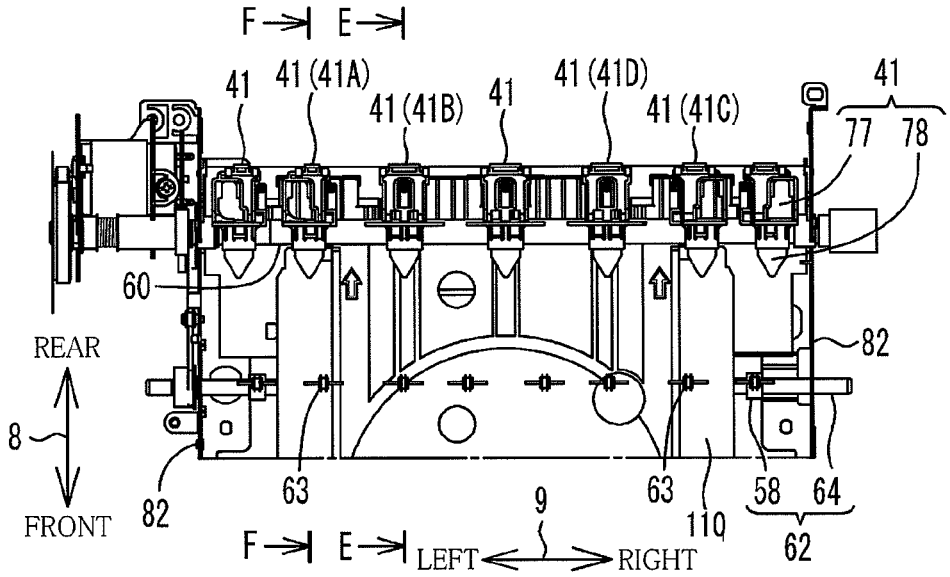
Figure 12F:
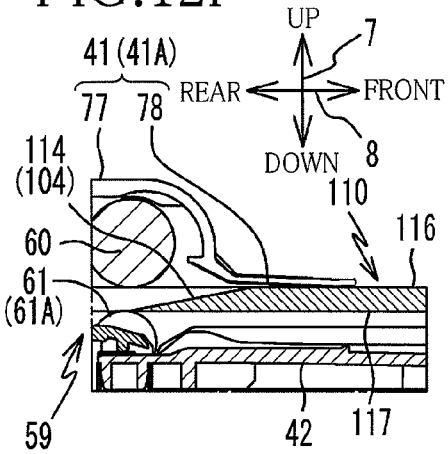

In the state illustrated in FIGS. 9C, 12C, and 12D, when the downstream edge portion 118 of the media tray 110 is moved further in the rear direction, as illustrated in FIGS. 10A and 12F, the third regions 103 on the lower face 117 of the downstream edge portion 118 are brought into contact with the upper end portions of the respective pinch rollers 61A. The third regions 103 on the lower face 117 are brought into contact with left portions of the pinch rollers 61A. At this contact, as described above, the pinch rollers 61A have already been moved downward against the elastic members 66. Accordingly, there is a low possibility that the third regions 103 on the upper face 116 of the downstream edge portion 118 are unfortunately brought into contact with the pinch rollers 61A, which inhibits downward movement of the pinch rollers 61A.

Figure 10B:
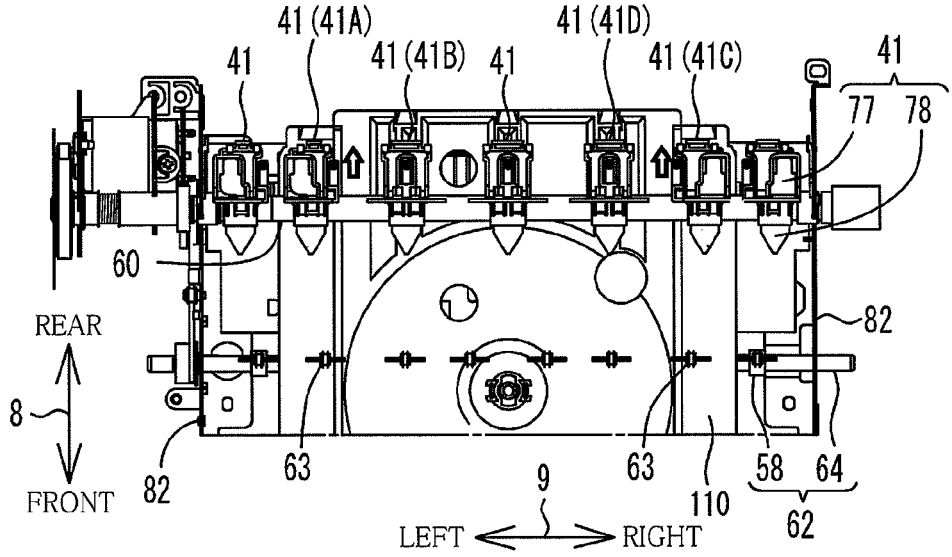

In the state illustrated in FIG. 10A, when the downstream edge portion 118 of the media tray 110 is moved further in the rear direction, the media tray 110 is conveyed, after establishing the state illustrated in FIG. 10B, to a position at which the storage medium is located at a rear of the recording unit 24. At this position, the downstream edge portion 118 of the media tray 110 projects from an opening 134 (see FIG. 2) formed in a back face of the MFP 10.

In this state, driving power to be transmitted from the conveyor motor to the conveyor roller 60 and the output roller 62 is switched from reverse-rotation driving power to forward-rotation driving power. This forward-rotation driving power causes the media tray 110 to be conveyed in the front direction, so that the storage medium placed on the media tray 110 passes through a position under the recording unit 24. The recording head 38 ejects ink droplets onto the storage medium conveyed under the recording unit 24 to record an image on the face of the storage medium. The media tray 110 is then discharged to the outside of the MFP 10 from the opening 13.

Effects in Embodiment

In the present embodiment, while the media tray 110 is being inserted into the MFP 10 to record an image on the storage medium, the first inclined faces 114 of the media tray 110 are brought into contact with the contact portions 78 of the respective contact members 41. This contact causes the contact portions 78 of the respective contact members 41 to be slid relative to the first inclined faces 114. As a result, the contact portions 78 of the respective contact members 41 are guided upward along the first inclined faces 114 and moved to a position above the media tray 110. This lowers the possibility that the insertion of the media tray 110 is inhibited by the contact members 41 having caught the media tray 110. That is, in the present embodiment, the media tray 110 which can support the storage medium can be inserted into the MFP 10 without being inhibited by the contact members 41 for corrugating the recording sheet 12.

In the present embodiment, the contact portions 78 contact the first inclined faces 114, so that the contact members 41 are bent upward. This construction eliminates a need to provide a mechanism for moving the contact members 41.

In the present embodiment, since the first inclined faces 114 are disposed corresponding to the contact members 41, the first inclined faces 114 can be provided only at necessary portions. In other words, the first inclined faces 114 do not need to be provided at unnecessary portions.

The first inclined faces 114 of the media tray 110 can be directly brought into contact with the contact portions 78 of the respective contact members 41 to guide the contact portions 78 onto the upper surface of the media tray 110.

In the present embodiment, while the media tray 110 is being inserted into the MFP 10, the downstream edge portion 118 of the media tray 110 in the tray inserting direction is brought into contact with the pinch rollers 61A which move by the distance D4. With this contact, the pinch rollers 61A are pushed by the media tray 110 and moved downward, so that the pinch rollers 61A can nip the media tray 110 with the conveying roller 60. However, if the first inclined faces 114 are brought into contact with the pinch rollers 61A which move by the distance D4, a position at which the first inclined faces 114 and the pinch rollers 61A contact each other is deviated to a lower position. This is because the first inclined faces 114 are located lower in height at their downstream edges in the tray inserting direction than at their upstream edges in the tray inserting direction. This situation may cause a problem that the pinch rollers 61A cannot be moved downward, and the conveying roller pair 59 cannot nip the media tray 110.

To address this problem, in the present embodiment, the downstream edge portion 118 of the media tray 110 in the tray inserting direction is constituted in the right and left direction 9 by: the first regions 101 on which the respective first inclined faces 114 are formed; and the second regions 102 on which the first inclined faces 114 are not formed, and the downstream edges of the downstream edge portion 118 in the respective second regions 102 are located higher in height than the downstream edges of the respective first inclined faces 114 in the tray inserting direction. The third regions 103 included in the first regions 101 and to be brought into contact with the pinch rollers 61A which move by the distance D4 are located in front of the second regions 102. In the right and left direction 9, the pinch rollers 61A which move by the distance D4 are arranged on an area including both of the third regions 103 and the second regions 102.

Consequently, the pinch rollers 61A which move by the distance D4 first contact the second regions 102 on the downstream edge portion 118 of the media tray 110 in the tray inserting direction, that is, the pinch rollers 61A which move by the distance D4 first contact the regions in which the first inclined faces 114 are not formed, and the downstream edges of the regions are located above the downstream edges of the respective first inclined faces 114 in the tray inserting direction. As a result, the second regions 102 of the downstream edge portion 118 of the media tray 110 in the tray inserting direction push and lower the pinch rollers 61A which move by the distance D4. The pinch rollers 61A which move by the distance D4 thereafter contact third regions 103 on the downstream edge portion 118 of the media tray 110 in the tray inserting direction, that is, the pinch rollers 61A contact the first inclined faces 114. At this time, the pinch rollers 61A have already been moved downward. This construction can reduce a possibility of an occurrence of the above-described situation, i.e., the situation in which the pinch rollers 61A cannot be moved away from the conveying roller 60.

In the present embodiment, when contacting the second regions 102, the pinch rollers 61A which move by the distance D4 can be smoothly moved downward while guided by the second inclined faces 115.

In the present embodiment, the media tray 110 is nipped by the conveying roller pair 59 only at opposite portions of the support region 111 in the right and left direction 9. This construction can prevent an occurrence of a problem that the lower face 117 of the media tray 110 which is an opposite side of the media tray 110 from the support region 111 is pushed by the pinch rollers 61B and thereby warped or moved in a direction in which the media tray 110 is warped. Accordingly, it is possible to prevent the storage medium supported on the support region 111 from being damaged by contacting the conveying roller 60.

First Modification

While the pinch rollers 61A are arranged at the opposite side areas in the right and left direction 9, and the pinch rollers 61B are arranged on the central area in the right and left direction 9 in the above-described embodiment, the present invention is not limited to this arrangement. For example, all the pinch rollers 61 may be configured like the pinch rollers 61A. That is, all the pinch rollers 61 may be configured to be moved downward by the distance D4.

Second Modification

While the conveying roller 60 is provided on an upper side, and the pinch rollers 61 on a lower side in the conveying roller pair 59 in the above-described embodiment, the pinch rollers 61 may be provided on an upper side, and the conveying roller 60 on a lower side. In this construction, the upper pinch rollers 61 are moved to switch the state of the conveying roller pair 59. Also, while the lower output roller 62 is moved to switch the state of the output roller pair 44 in the above-described embodiment, the upper spurs 63 may be moved to switch the state of the output roller pair 44.

The MFP 10 may be configured such that, in the case where an image is recorded on the recording sheet 12, the spurs 63 are used, and in the case where an image is recorded on the storage medium, driven rollers rotated by the output roller 62 (i.e., a roller having no projections and recessions on a roller surface unlike the spurs 63) is be used instead of the spurs 63. In this case, for example, the spurs 63 and the above-described driven rollers are moved upward and downward with the movement of the lever 90, and when the lever 90 is moved from the first position to the second position, the spurs 63 are retracted upward, and the above-described driven rollers are moved into the straight portion 34. When the lever 90 is moved from the second position to the first position, the above-described driven rollers are retracted upward, and the spurs 63 are moved into the straight portion 34.

In the above-described embodiment, the pinch rollers 61 are urged by the respective elastic members 66 toward the conveying roller 60, and the output roller 62 by the respective elastic members toward the spurs 63. In contrast, however, the conveying roller 60 may be urged by elastic members toward the pinch rollers 61, and the spurs 63 by elastic members toward the output roller 62.

Third Modification

The direction of movement of the pinch rollers 61 and the output roller 62 is not limited to the up and down direction 7. For example, the pinch rollers 61 and the output roller 62 may be moved in a direction inclined with respect to the up and down direction 7.

Fourth Modification

One contact member 41 is disposed between each adjacent two of the ribs 120 provided on the platen 42 in the right and left direction 9 in the above-described embodiment, that is, the contact members 41 and the ribs 120 are alternately arranged in the right and left direction 9 in the above-described embodiment. However, one contact member 41 may not be disposed between each adjacent two of the ribs 120 in the right and left direction 9. For example, one contact member 41 may be disposed between each adjacent two of some of the ribs 120 in the right and left direction 9. That is, one contact member 41 only needs to be disposed in at least one of positions between the respective ribs 120 in the right and left direction 9.

Fifth Modification

The first inclined faces 114 are provided only at the positions corresponding to the contact portions 78 of the respective contact members 41 in the right and left direction 9 in the above-described embodiment but may also be provided at positions not corresponding to the contact portions 78.

Sixth Modification

The downstream edge portion 118 of the media tray body 112 is constituted by the first regions 101 and the second regions 102 in the right and left direction 9 in the above-described embodiment but may be constituted by only the first regions 101. That is, the first inclined faces 114 may be formed over the entire downstream edge portion 118 in the right and left direction 9.

Seventh Modification

The first regions 101 are constituted by the third regions 103 and the fourth regions 104 in the above-described embodiment, but the present invention is not limited to this construction. For example, the first regions 101 may be constituted by the third regions 103, the fourth regions 104, and regions to be brought into contact with the pinch rollers 61B which move by the distance D3 as long as at least a part of the first inclined faces 114 is provided corresponding to the pinch rollers 61B in the right and left direction 9. Also, the first regions 101 are constituted by the third regions 103 and regions to be brought into contact with the pinch rollers 61B which move by the distance D3 as long as all the first inclined faces 114 are provided at positions corresponding to the pinch rollers 61 in the right and left direction 9.

Eighth Modification

The media tray 110 is inserted from the opening 13 formed in the front face of the MFP 10 in the above-described embodiment but may be inserted from the opening 134 formed in the rear face of the MFP 10. In this case, after an image is recorded by the recording unit 24 onto the storage medium placed on the media tray 110 being conveyed in the front direction, the media tray 110 may be discharged from the opening 13 formed in the front face of the MFP 10 and may be discharged from the opening 134 formed in the rear face of the MFP 10.

Ninth Modification

In the above-described embodiment, the basal end portions 77 are mounted on the guide rail 56, and the contact portions 78 contact the first inclined faces 114, whereby the contact members 41 are bent upward. However, the entire contact members 41 may be movable in the up and down direction 7. For example, the contact members 41 may be configured such that the basal end portions 77 are mounted on the guide rail 56 movably in the up and down direction 7, and the contact members 41 are normally located at a lower position by its own weight and such that the contact portions 78 are lifted by contacting the first inclined faces 114, and thereby the entire contact members 41 are moved upward. In this case, since the contact members 41 cannot be lifted by the recording sheet 12, the recording sheet 12 can be corrugated.

Tenth Modification

In the above-described embodiment, the height position of the contact portions 78 of the respective contact members 41 is the same as that of the first inclined faces 114 of the media tray 110 conveyed through the straight portion 34. This construction allows the contact between the contact portions 78 and the first inclined faces 114. However, in a case where the conveying roller pair 59 is switched from the first state to the second state by upward movement of the pinch rollers 61 disposed on an upper side as in the second modification, the height position of the contact portions 78 of the respective contact members 41 is, as illustrated in FIG. 11B, lower than that of the first inclined faces 114 of the media tray 110 conveyed through the straight portion 34.

In this case, for example, a construction as illustrated in FIGS. 11A-11F allows the contact members 41 to move onto the upper surface of the media tray 110. The detailed explanation will be provided below. Protrusions 76 projecting in the right and left direction 9 are provided between the basal end portions 77 and the contact portions 78 of the respective contact members 41. Protrusions 121 projecting from the downstream edge portion 118 of the media tray 110 are provided on the downstream edge portion 118 so as to correspond to the protrusions 76 in the right and left direction 9. Third inclined faces 123 inclining like the first inclined faces 114 are respectively provided on distal end portions of the respective protrusions 121.

Figure 11A:
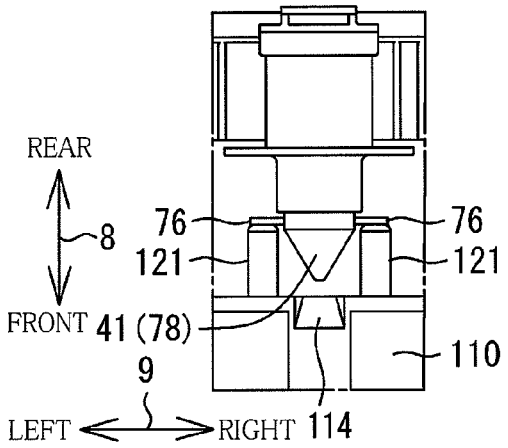
Figure 11B:
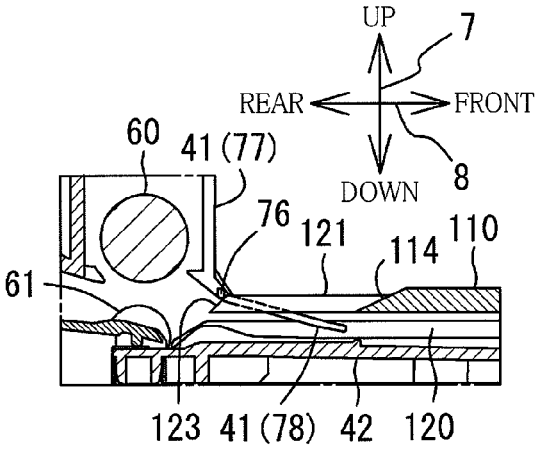

When the media tray 110 is conveyed in the rear direction through the straight portion 34, as illustrated in FIGS. 11A and 11B, the protrusions 121 are first brought into contact with the respective protrusions 76, so that the protrusions 76 are guided by the third inclined faces 123. As a result, the contact portions 78 of the respective contact members 41 are bent upward and located at the same height position as the first inclined faces 114.

Figure 11C:
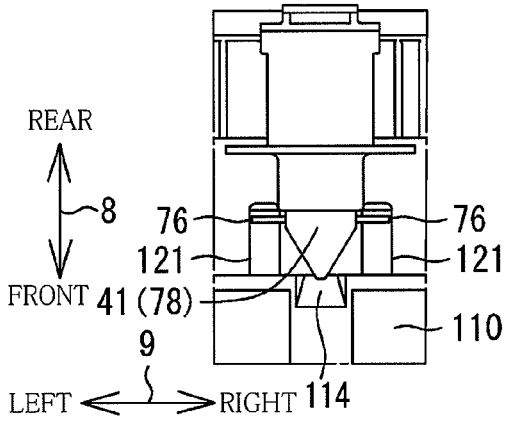
Figure 11D:
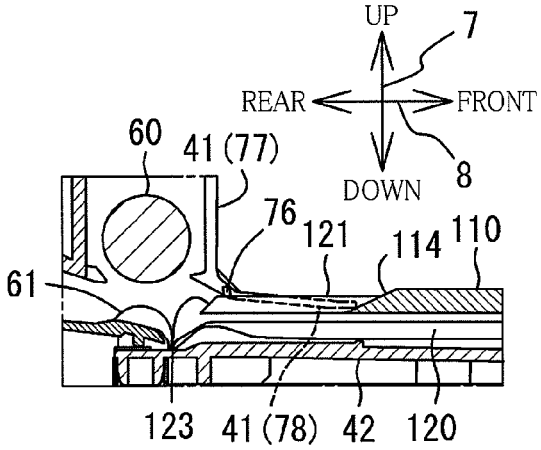
Figure 11E:
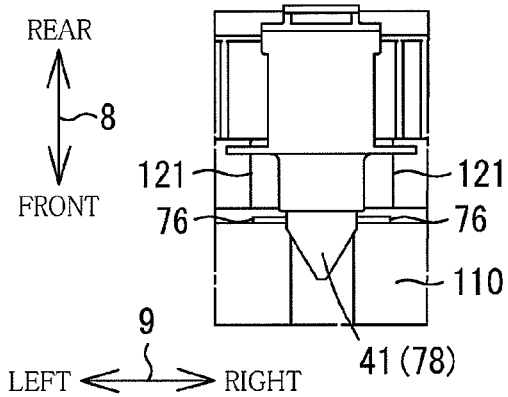
Figure 11F:
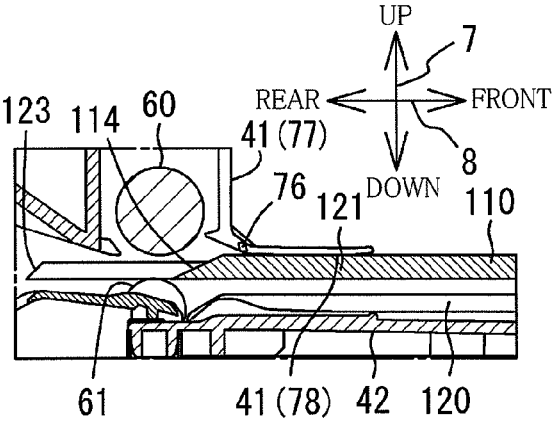

When the media tray 110 is further conveyed in the rear direction in this state, as illustrated in FIGS. 11C and 11D, the contact portions 78 of the contact members 41 are brought into contact with the respective first inclined faces 114, so that the contact portions 78 are guided by the respective first inclined faces 114. As a result, the contact portions 78 of the respective contact members 41 are bent upward. That is, the contact members 41 are moved onto the upper surface of the media tray 110 (see FIGS. 11E and 11F).

Eleventh Modification

While the state of each of the conveying roller pair 59, the output roller pair 44, and the platen 42 is switched by the lever 90 in the above-described embodiment, a method of switching the state is not limited to this method. For example, the conveying roller pair 59, the output roller pair 44, and the platen 42 may be moved in the up and down direction 7 by driving power applied from the motor.

What is claimed is:

1. An ink-jet recording apparatus, comprising:

a media tray configured to support a recording medium;

a roller pair comprising a first roller and a second roller opposite the first roller, a state of the roller pair being switched between a first state in which the first roller and the second roller nip a sheet and a second state in which the first roller and the second roller are spaced apart from each other by a greater distance than in the first state and capable of nipping the media tray, the first roller being a driving roller, the second roller being a driven roller driven by the first roller;

a recording device comprising a plurality of nozzles and disposed downstream of the roller pair in a conveying direction in which the sheet is conveyed, the recording device being configured to eject ink droplets from the plurality of nozzles onto one of the sheet and the recording medium supported on the media tray;

a plurality of lower contact portions disposed downstream of a sheet nipping position of the roller pair in the conveying direction, the plurality of lower contact portions being arranged spaced apart from each other in a widthwise direction intersecting the conveying direction, the plurality of lower contact portions being configured to contact a lower side of the sheet; and at least one upper contact portion disposed between the sheet nipping position of the roller pair and the plurality of nozzles in the conveying direction, the at least one upper contact portion being disposed between adjacent two of the plurality of lower contact portions in the widthwise direction, the at least one upper contact portion being configured to contact an upper side of the sheet, the at least one upper contact portion being configured to cooperate with the plurality of lower contact portions to corrugate the sheet, the media tray comprising a downstream edge portion in a tray inserting direction in which the media tray is inserted, the downstream edge portion being provided with at least one inclined portion inclining obliquely upward toward an upstream side in the tray inserting direction, the at least one inclined portion being configured to contact the at least one upper contact portion to move the at least one upper contact portion upward, wherein the downstream edge portion of the media tray in the tray inserting direction comprises: a first portion corresponding in the widthwise direction to a region in which the at least one inclined portion is formed; and a second portion corresponding in the width wise direction to a region in which the at least one inclined portion is not formed, the first portion being contactable with the second roller.

2. The ink-jet recording apparatus according to claim 1, wherein a lower edge of each of the at least one upper contact portion is located below upper edges of the plurality of lower contact portions.

3. The ink-jet recording apparatus according to claim 1, wherein the at least one upper contact portion is bent upward by contacting the at least one inclined portion.

4. The ink-jet recording apparatus according to claim 1, wherein the at least one inclined portion is disposed corresponding to the at least one upper contact portion.

5. The ink-jet recording apparatus according to claim 1, wherein each of the at least one upper contact portion is disposed between corresponding adjacent two of the plurality of lower contact portions in the widthwise direction.

6. The ink-jet recording apparatus according to claim 1, wherein a lower roller of the first roller and the second roller is moved downward to switch the state of the roller pair from the first state to the second state, and wherein a lower edge of each of the at least one upper contact portion is located below a position at which the sheet is nipped by the roller pair being in the first state and above the lower roller being in the second state.

7. The ink-jet recording apparatus according to claim 1, comprising a plurality of second rollers each as the second roller, wherein the plurality of second rollers are arranged below the first roller and opposite the first roller in a state in which the plurality of second rollers are spaced apart from each other in the widthwise direction, wherein each of the plurality of second rollers is urged by an elastic member in a direction toward the first roller and movable in the direction toward the first roller and in a direction away from the first roller, wherein the ink-jet recording apparatus further comprises a moving mechanism configured to switch the state of the roller pair from the first state to the second state by moving at least one second roller of the plurality of second rollers in the direction away from the first roller by a first distance which is less than a thickness of the media tray and by moving a remaining one or ones of the plurality of second rollers other than the at least one second roller in the direction away from the first roller by a second distance which is greater than the thickness of the media tray, wherein a downstream edge of the second portion in the tray inserting direction is located above a downstream edge of the at least one inclined portion in the tray inserting direction, wherein the first portion comprises a third portion contactable with the at least one second roller and disposed upstream of the second portion in the tray inserting direction, and wherein the at least one second roller is disposed on both of a region of the second portion in the widthwise direction and a region of the third portion in the widthwise direction.

8. The ink-jet recording apparatus according to claim 7, wherein a lower face of the second portion of the media tray comprises at least one inclined face inclining obliquely downward toward an upstream side in the tray inserting direction.

9. The ink-jet recording apparatus according to claim 7, wherein the media tray comprises a support region which supports the recording medium, wherein the plurality of second rollers comprise: at least two second rollers located on opposite sides of the support region of the media tray in the widthwise direction; and at least one second roller located within the support region of the media tray, and wherein the moving mechanism is configured to move the at least two second rollers by the first distance and move the at least one second roller by the second distance.

10. The ink-jet recording apparatus according to claim 1, wherein the media tray is inserted, in a direction opposite the conveying direction, from a downstream side of the recording device in the conveying direction.

11. The ink-jet recording apparatus according to claim 1, further comprising a supply tray provided upstream of the roller pair in the conveying direction and configured to support the sheet to be supplied to the roller pair.

12. The ink-jet recording apparatus according to claim 1, wherein the at least one upper contact portion inclines downward from an upstream side toward a downstream side in the conveying direction.

13. A media tray to be inserted into an ink-jet recording apparatus, the media tray comprising: a media tray body having a plate shape; and a support portion which is provided on an upper face of the media tray body and supports a recording medium on which an image is to be recorded by the ink-jet recording apparatus, the ink-jet recording apparatus comprising:

a roller pair comprising a first roller and a second roller opposite the first roller, a state of the roller pair being switched between a first state in which the first roller and the second roller nip a sheet and a second state in which the first roller and the second roller are spaced apart from each other by a greater distance than in the first state and capable of nipping the media tray, the first roller being a driving roller, and the second roller being a driven roller driven by the first roller;

a recording device comprising a plurality of nozzles and disposed downstream of a sheet nipping position of the roller pair in a conveying direction in which the sheet is conveyed, the recording device being configured to eject ink droplets from the plurality of nozzles onto one of the sheet and the recording medium supported on the media tray;

a plurality of lower contact portions disposed downstream of the sheet nipping position of the roller pair in the conveying direction, the plurality of lower contact portions being arranged spaced apart from each other in a widthwise direction intersecting the conveying direction, the plurality of lower contact portions being configured to contact a lower side of the sheet; and at least one upper contact portion disposed between the sheet nipping position of the roller pair and the plurality of nozzles in the conveying direction, the at least one upper contact portion being disposed between adjacent two of the plurality of lower contact portions in the widthwise direction, the at least one upper contact portion being configured to contact an upper side of the sheet, the at least one upper contact portion being configured to cooperate with the plurality of lower contact portions to corrugate the sheet, the media tray comprising a downstream edge portion in a tray inserting direction in which the media tray is inserted, the downstream edge portion being at least a portion of the upper face of the media tray body, the downstream edge portion being provided with at least one inclined portion inclining obliquely upward in the tray inserting direction, the at least one inclined portion being configured to contact the at least one upper contact portion to move the at least one upper contact portion upward, wherein the downstream edge portion of the media tray in the tray inserting direction comprises: a first portion corresponding in the widthwise direction to a region in which the at least one inclined portion is formed; and a second portion corresponding in the widthwise direction to a region in which the at least one inclined portion is not formed, the first portion being contactable with the second roller.

14. The ink-jet recording apparatus according to claim 1, wherein the at least one upper contact portion overlaps the plurality of lower contact portions when viewed in the widthwise direction.

15. The ink-jet recording apparatus according to claim 1, wherein the at least one upper contact portion overlaps the plurality of lower contact portions when viewed in the widthwise direction.

16. The ink-jet recording apparatus according to claim 1, wherein a downstream edge of the second portion in the tray inserting direction is located above a downstream edge of the at least one inclined portion in the tray inserting direction.

17. The ink-jet recording apparatus according to claim 1, wherein the first portion comprises a third portion contactable with the at least one second roller and disposed upstream of the second portion in the tray inserting direction, and wherein the at least one second roller is disposed on both of a region of the second portion in the width wise direction and a region of the third portion in the widthwise direction.

* * * * *